US007735332B2

(12) United States Patent
Lee et al.

(10) Patent No.: US 7,735,332 B2
(45) Date of Patent: Jun. 15, 2010

(54) AIR CONDITIONER

(75) Inventors: Jong Ho Lee, Kimhae-si (KR); Moon Shin Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 219 days.

(21) Appl. No.: 11/710,468

(22) Filed: Feb. 26, 2007

(65) Prior Publication Data

US 2008/0000251 A1 Jan. 3, 2008

(30) Foreign Application Priority Data

Jul. 3, 2006 (KR) ..... 10-2006-0061888
Nov. 6, 2006 (KR) ..... 10-2006-0109176

(51) Int. Cl.
*F25D 21/14* (2006.01)

(52) U.S. Cl. ..... 62/291

(58) Field of Classification Search ..... 62/291, 62/286, 288
See application file for complete search history.

(56) References Cited

U.S. PATENT DOCUMENTS 3,727,421 A 4/1973 Berg
5,271,242 A * 12/1993 Addington ..... 62/285
5,461,880 A * 10/1995 Bolton et al. ..... 62/298
6,098,416 A * 8/2000 Addington et al. ..... 62/298
6,389,831 B1 * 5/2002 AN ..... 62/262
6,412,298 B2 * 7/2002 Kang et al. ..... 62/262
6,892,551 B2 * 5/2005 Gunji et al. ..... 62/262
2005/0056037 A1 * 3/2005 Park et al. ..... 62/262
2005/0284170 A1 * 12/2005 Lee et al. ..... 62/419
2006/0021370 A1 * 2/2006 Cho et al. ..... 62/262

FOREIGN PATENT DOCUMENTS

EP 0979977 A2 2/2000
EP 0981030 A2 2/2000
JP 2000-205596 7/2000
JP 2003-262356 9/2003
KR 252478 8/2001

* cited by examiner

*Primary Examiner*—Cheryl J Tyler
*Assistant Examiner*—Lakiya Rogers
(74) *Attorney, Agent, or Firm*—McKenna Long & Aldridge LLP

(57) ABSTRACT

There is provided an air conditioner. The air conditioner includes a main drain pan dividing an inner space of the air conditioner into upper and lower halves, a base pan defining a lower outer appearance of the air conditioner, an indoor blower unit that is installed on an upper portion of the main drain pan to guide introduction and discharge of indoor air, and a control box in which a plurality of electronic components controlling the operation of the air conditioner are installed. The control box is installed vertically across the main drain pan.

15 Claims, 23 Drawing Sheets

AIR CONDITIONER

This application claims the benefit of Korean Patent Application Nos. 10-2006-0061888 filed on Jul. 3, 2006 and 10-2006-0109176 filed on Nov. 6, 2006, which are hereby incorporated by reference for all purposes as if fully set forth herein.

BACKGROUND OF THE INVENTION

1. Field of the Invention

The present invention relates to an air conditioner and, more particularly, an air conditioner in which a control box in which electronic components are installed are installed in a vertical direction and fixed to a main drain pan and an indoor blower unit.

2. Description of the Related Art

Generally, an air conditioner includes a compressor, an expansion valve, and an indoor heat exchanger. The air conditioner uniformly maintains a room temperature to provide an enjoyable atmosphere to human beings.

That is, the air conditioner is a heating/cooling device installed at an indoor space of a room, office, or home to heat or cool the indoor space. The air conditioner has a cooling cycle such as compressor-outdoor heat exchanger-expansion valve-indoor heat exchanger or a heating cycle formed by a reverse circulation of the refrigerant.

Since the conventional air conditioner, however, is large-sized or is generally installed on a wall of a building, it is difficult to move the air conditioner once installed. This is troublesome for a user.

Therefore, recently, a movable air conditioner having wheels at a bottom thereof has been developed to provide a using convenience to the user. Such a movable air conditioner is disclosed in Korean Utility Model No. 0252478.

In the conventional movable air conditioner, a control box occupies a large space, increasing an overall size of the air conditioner. In addition, electronic components that generate heat, such as a capacitor, are disposed in the control box. The control box is enclosed by a cover. Therefore, the electronic components may be damaged by the heat generated and accumulated in the control box.

Furthermore, since an inner space of the control box when the cover is opened is small, it is difficult to mount the electronic components in the control box and the assembling capability is deteriorated.

SUMMARY OF THE INVENTION

Accordingly, the present invention is directed to an air conditioner that substantially obviates one or more problems due to limitations and disadvantages of the related art.

An object of the present invention is to provide an air conditioner that can maximize the space efficiency by mounting a control box in a vertical direction at a front side of a main drain pan.

Another object of the present invention is to provide an air conditioner that has a capacitor that is exposed out of a control box by penetrating a side of the control box and thus cooled by air flowing in the air conditioner.

Still another object of the present invention is to provide an air conditioner having a control box that can selectively fold one side thereof so as to improve the assembling capability by mounting electronic components in a state where the one side is unfolded.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an air conditioner including: a main drain pan dividing an inner space of the air conditioner into upper and lower halves; a base pan defining a lower outer appearance of the air conditioner; an indoor blower unit that is installed on an upper portion of the main drain pan to guide introduction and discharge of indoor air; and a control box in which a plurality of electronic components controlling the operation of the air conditioner are installed, wherein the control box is installed vertically across the main drain pan.

In another aspect of the present invention, there is provided an air conditioner including: a main drain pan dividing an inner space of the air conditioner into upper and lower halves; and a control box in which a plurality of electronic components controlling the operation of the air conditioner are installed, the control box being installed vertically across the main drain pan, wherein the control box includes a box body in which the electronic components are installed and a box cover for closing an opening front portion of the box body; and the box body is provided at a side with a side shielding part defining an outer appearance of a side surface of the box body and the side shielding part is formed at an end of the box body to be capable of being bent.

According to the present invention, the control box is mounted crossing in a vertical direction in a state where it is inserted in a control box installation part concaved on a front part of the main drain pan. Therefore, the space efficiency of the air conditioner can be maximized and thus the air conditioner can be more compact.

In addition, the capacitor is exposed out of the control boxy by penetrating a side of the control box. Therefore, the capacitor can be air-cooled by air flowing in the air conditioner and thus the damage of the electron components in the control box can be prevented in advance.

Further, since a side of the control box is designed to be folded, the assembling capability of the electronic components in the control box can be improved.

In addition, since the control box support supports the control box seating on the control box installation part, the dropping of the control box can be prevented. Therefore, the safety is ensured during the installation of the control box and the installation stability can be improved.

Furthermore, in the air condition according to the present invention, the control box is installed on an extreme end of the main drain pan, therefore a length of the wire connecting the electronic components to the control panel can be reduced. By the reduction of the wire, the manufacturing cost is reduced and the short circuit can be prevented. Therefore, the reliability of the product can be improved.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
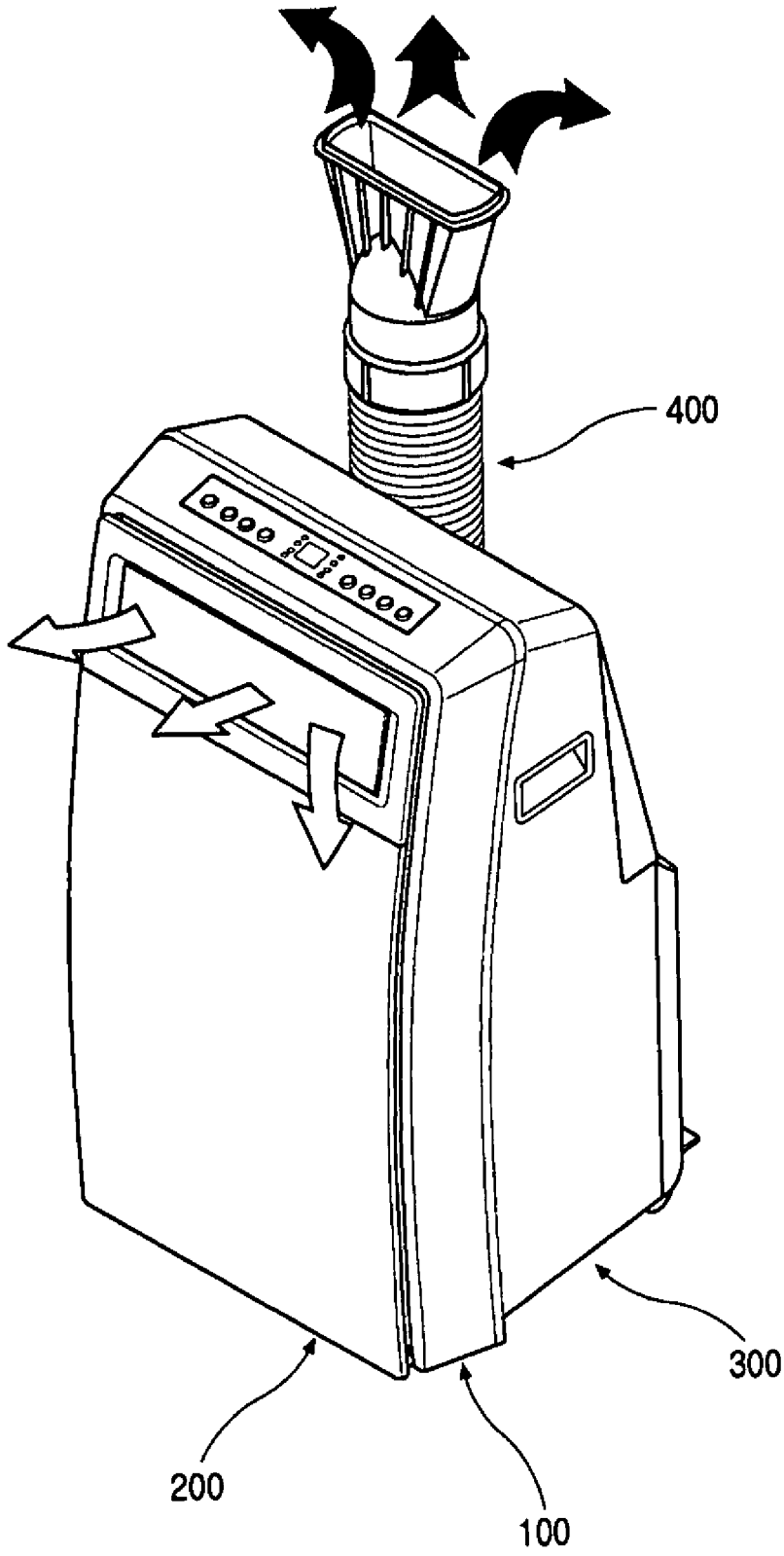
FIG. 1 is a front perspective view of an air conditioner according to an embodiment of the present invention.
Figure 2:
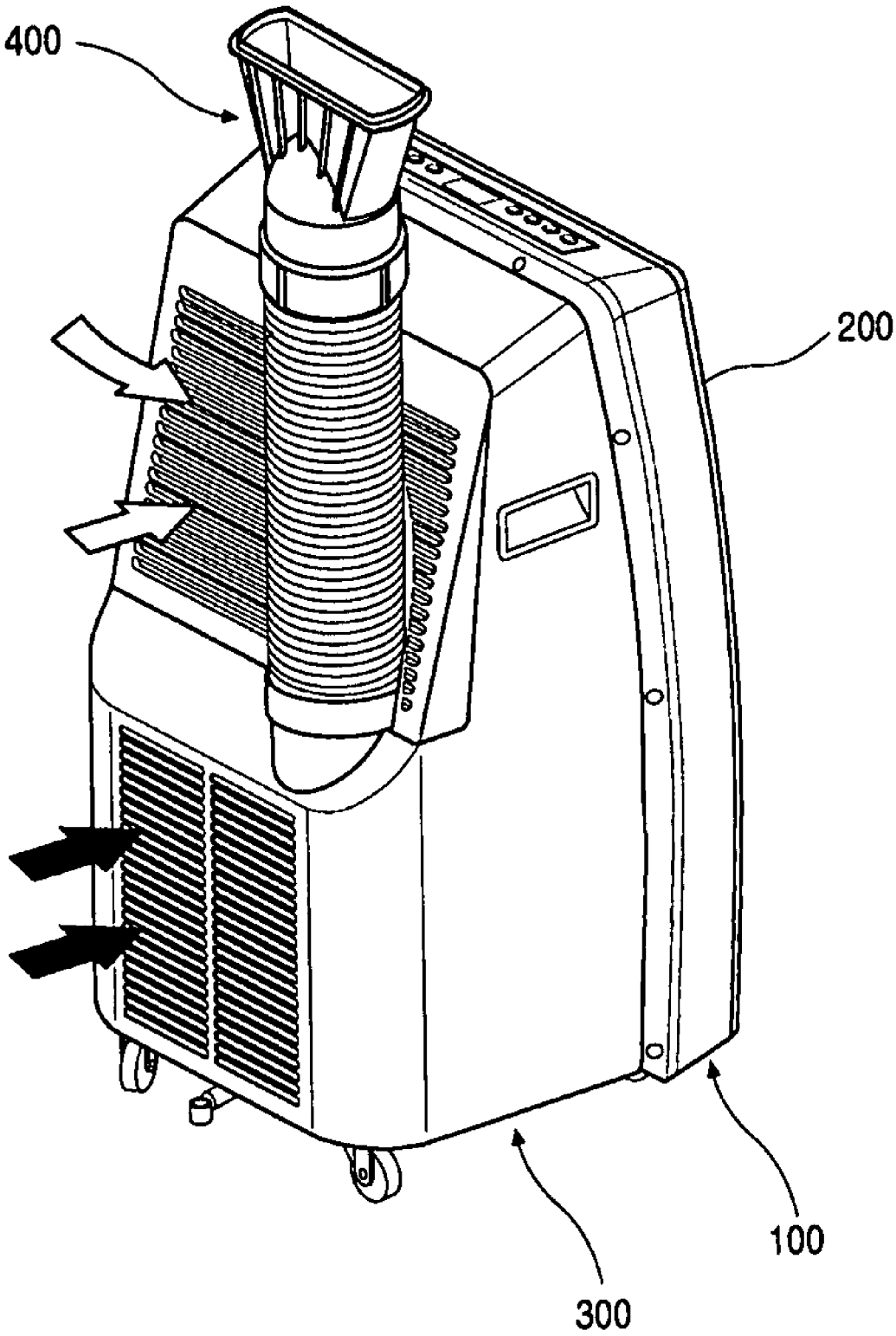
FIG. 2 is a rear perspective view of an air conditioner according to an embodiment of the present invention.

FIGS. 1 and 2 are respective front and rear perspective views of an air conditioner according to an embodiment of the present invention.

Referring to FIGS. 1 and 2, an air condition according to an embodiment of the present invention includes a front frame 100 defining an outer appearance of a front half of the air conditioner and a rear frame defining a rear appearance of a rear half of the rear frame 300.

The front frame 100 forms a frame of the front half of the air conditioner and forms partly a top part and left and right sides of the air conditioner. A control panel PCB 124 is provided on the control panel 120. The user controls the operation of the air conditioner using the control panel 120.

The rear frame 300 partly forms the top surface and left and right sides of the air conditioner as well as the rear half of the air conditioner. An exhaust guide unit 400 for exhausting air heat-exchanged to an external side is connected to the rear frame 300. The exhaust guide unit 400 will be described in more detail later.

Figure 3:
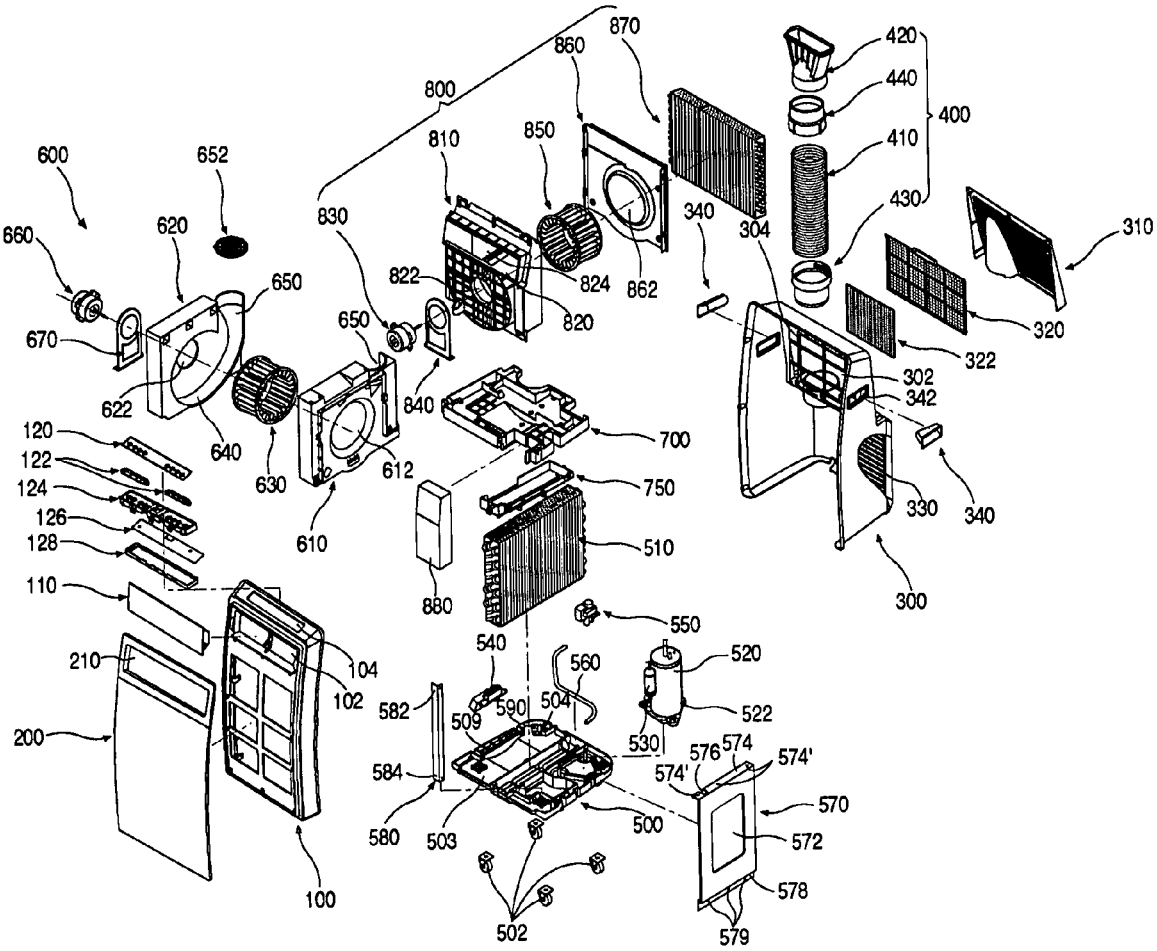
FIG. 3 is an exploded perspective view of an internal structure of an air conditioner according to an embodiment of the present invention.

FIG. 3 is an exploded perspective view of an internal structure of the air conditioner.

Referring to FIG. 3, the front frame 100 is rectangular-shaped. The front frame 100 protrudes frontward at its central part. Therefore, the front frame 100 has a generally rounded profile.

A grille installation opening 102 is formed near an upper end of the front frame 100. The grille installation opening 102 is a part where a discharge louver 110 that will be described later is installed and is formed in a rectangular shape extending in a horizontal direction.

A top surface of the front frame 100 is inclined at a predetermined angle. The front frame 100 is provided with a panel opening 104 in which the control panel 120 will be installed. The panel opening 104 is formed in a rectangular shape corresponding to a shape of the control panel 120. The front panel 200 is formed in a rectangular shape to define a front appearance of the air conditioner. The front panel 200 is fixed on the front part of the front frame 100. Therefore, the front panel 200 has a corresponding shape to the front surface of the front frame 100. That is, like the front frame 100, the front panel 200 an upper end of a central part of the front panel 200 further protrudes than a lower end of the central part. That is, the front panel 200 is rounded (circular-arc-shaped).

The discharge louver 110 through which heat-exchanged air is exhausted to an external side is installed in the grille installation opening 102. The discharge louver 110 is provided to adjust an exhaust direction of the air. A plurality of discharge louver plates are provided in the discharge louver 110 to direct the air downward, upward, leftward, or rightward. The control panel 120 is installed in the panel opening 104. The control panel 120 is provided with a plurality of buttons. That is, a pair of button assemblies 122 are provided at a lower part of the control panel 120 and the buttons are provided on the button assemblies 122 and exposed upward through the control panel 120.

A control PCB 124 is installed under the button assemblies 122. The control PCB 124 converts a button operation of the button assemblies 122 into a signal and transmits the signal to a control unit (not shown). The control PCB 124 is supported by a control frame 126. The control PCB 124 is enclosed by a box-shaped PCB case 128.

An exhaust hole 210 is formed through a part near the upper end of the front panel 200. The heat-exchanged air is exhausted frontward through the exhaust hole 210. Therefore, the exhaust hole 210 is formed in a rectangular shape corresponding to the discharge louver 110.

The rear frame 300 is coupled to the front frame 100. Therefore, the front end of the rear frame 300 is formed to correspond in a shape to the front frame 100. That is, left and right side front end parts of the rear frame 300 protrude frontward to be rounded at their central parts and to correspond to left and right side rear end parts of the front frame 100.

An external air inlet 302 is formed at an upper half of the rear frame 300. The external air inlet 302 defines a passage through which the external air (indoor air) is introduced into the air conditioner. The external air inlet 302 is formed in a rectangular shape.

The external air inlet 302 is provided at a central part with a rectangular filter frame 304 corresponding to the external air inlet 302. The filter frame 304 is smaller than the external air inlet 302. The filter frame 304 supports a special filter such as a deodorization filter 322.

The external air inlet 302 is closed by an intake grille 310. The external air (indoor air) is introduced into the air conditioner through the intake grille. Therefore, the intake grille 310 is provided with a plurality of holes. The intake grille 310 is sized to correspond to the external air inlet 302. The intake grille 310 is slightly inclined frontward.

A pre-filter 320 is installed on a frame of the external air inlet 302. The pre-filter 320 is provided to filter foreign objects contained in the air introduced through the intake grille 310. A size of the pre-filter corresponds to that of the external air inlet 302. The deodorization filter 322 is provided in front of the pre-filter 320. The deodorization filter 322 is provided to remove offensive odor from the air introduced through the intake grille 310. A size of the deodorization filter 322 corresponds to that of the filter frame 304 and thus is fixed on the filter frame 304.

A lower grille 330 is integrally formed with a lower half of the rear frame 300. The lower grille 330 guides the air into the air conditioner and prevents the foreign objects from introducing into the air conditioner.

A handle 340 is provided on the rear frame 300. That is, a handle opening 342 is installed near left and right side upper end of the rear frame 300 and the handle 340 is inserted into the handle opening 342. The handle 340 is provided to allow a user to easily lift and move the air conditioner.

The exhaust guide unit 400 is connected to the rear frame 400. The exhaust guide unit 400 is provided to exhaust heat exchanged air in the air conditioner to an outdoor side. The exhaust guide unit 400 has a first end connected to the rear frame 300 and a second end exposed to the outdoor side.

The exhaust guide unit 400 is installed to communicate with an inside of the lower half of the rear frame 300, including an exhaust duct 410, an exhaust nozzle 420, and a frame connector 430, and a nozzle connector 440.

The exhaust nozzle 420 defines an end part for finally exhausting the air through the exhaust duct 410. The exhaust duct 410 is formed of a flexible material or shape so that it can be bent. The frame connector 430 is provided between the rear frame 300 and the exhaust duct 410 so as to guide the installation of the lower end of the exhaust duct 410 on the rear frame 300. The nozzle connector 440 is provided between to exhaust duct 410 and the exhaust nozzle 420 so as to guide the coupling of the upper end of the exhaust duct to the exhaust nozzle.

A lower outer appearance of the air conditioner is formed by a base pan 500. The base pan 500 is coupled to lower ends of the front and rear frames 100 and 300 and supports a plurality of components that will be described later. As shown in the drawing, the base pan 500 is formed in a rectangular shape.

A plurality of wheels 502 are installed on a bottom of the base pan 500. The wheels 502 are provided to easily move the air conditioner and provided at the respective corners of the rectangular base pan 500.

A first heat exchanger 510 is installed on a top-central part of the base pan 500. That is, the first heat exchanger 510 is installed at the central part of the base pan in the front-rear direction.

The first heat exchanger 510 functions to cool and heat the refrigerant by allowing the refrigerant to be heat-exchanged with the air.

That is, the air introduced through the lower grille 330 formed on the lower half of the rear frame 300 heat-exchanges with the refrigerant flowing along the first heat exchanger 510 while passing through the first heat exchanger 510 and is then exhausted to the external side (outdoor side) through the exhaust guide unit 400.

A compressor 520 is installed at a right side of the first heat exchanger 510. The compressor 520 is installed at a right-rear end part of the base pan 500 and supported by a triangular shape compressor frame 522. The compressor frame 522 is installed on the base pan 500.

An accumulator 530 is installed beside the compressor 520. The accumulator 530 filters a liquid refrigerant so that only a gaseous refrigerant can be introduced into the compressor 520.

A condensed water detection unit 540 is installed in front of the compressor 520. The condensed water detection unit 540 detects the condensed water when it is collected on a top surface of the base pan 500 by a predetermined amount and displays the detected result.

A condensed water pump 550 is further installed on a right front end of the base pan 500. The condensed water pump 550 pumps out the collected condensed water in the base pan 500 to a sub-drain pan 750. A condensed water pipe 560 is connected to the condensed pump 550. The condensed water pipe 560 functions as a passage for guiding the condensed water pumped by the condensed water pump 550 to the sub-drain pan 750. Therefore, a lower end of the condensed water pipe 560 is connected to the condensed pump 550 and an upper end is connected to the sub-drain pan 750.

A brace 570 is further installed on a right end of the base pan 500. The brace 570 is formed in a rectangular plate to support the right end of a main drain pan 700 that will be described later.

Describing the brace 570 in more detail, the brace 570 is provided at a right surface central part with a strength reinforcing groove 572 formed in a substantially rectangular groove. That is, the strength reinforcing groove 572 is provided to enhance and reinforce the strength of the brace 570. A drain pan support 574 is provided on a left-upper end of the brace 570. The drain pan support 574 contacts and is screw-coupled to the main drain pan 700.

To this end, support coupling holes 574' are respectively formed through front and rear parts and a central part of the drain fan support 574. The support coupling holes 574' are formed at a location corresponding to brace coupling parts (see FIG. 23) so that the upper end of the brace 570 can be coupled to a bottom of the main drain fan 700.

The drain pan support 574 is provided with a cut-away part 576 cut in a rectangular shape from a left end toward a right side at the upper half thereof. The cut-away part 576 is formed so as not to interfere with the condensed water drain pipe 560. That is, the cut-away part 576 is formed to correspond to a drain pipe passing groove (726 of FIG. 22).

A base fitting part 578 that is bent in a "≧"-shape extends from a lower end of the brace 570. The base fitting part 578 is inclined downward at it goes frontward so that it is inserted in a brace support (see FIG. 14) when the brace 570 is coupled to the top surface of the base pan 500.

That is, the top surface of the base pan 500 is designed to have a front-right side which has a lowest level and on which the condensed water pump 550 is installed. Therefore, when the base fitting part 578 is erected to contact the top surface of the base pan 500, the drain pan support 574 is inclined downward as it goes frontward.

Therefore, in order for the drain pan support 574 to horizontally support the main drain pan 700, the lower end of the base fitting part 578 is inclined downward as it goes frontward.

A plurality of brace coupling parts 579 are formed in the base fitting part 578. The brace coupling parts 579 are screw-coupled to the base pan 500 in a state where the brace 570 seats on the top surface of the base pan 500.

Therefore, when the brace coupling part 579 is coupled to a side of the base pan 500, the brace 570 is locked by the base pan 500.

A supporting angle 580 is further provided on a front end of the base pan 500. The supporting angle 580 is provided to support the right-upper part of the air conditioner. The supporting angle 580 is vertically installed at a front-right part of the base pan 500 to support the front end load of the main drain pan 700.

The supporting angle 580 is formed by bending a rectangular plate at a right angle to have a V-shape when it is viewed from a top. The supporting angle 580 has a lower end coupled to a right front end of the base pan 500 and an upper end coupled to a right front end of the main drain pan 700.

To this end, the supporting angle 580 is provided at an upper part with a drain coupling part 582. The drain coupling part 582 is provided at each of the front and right surfaces of the supporting angle 580 and located at a location lower than the drain coupling part 582.

Accordingly, when the drain coupling parts 582 and the base coupling parts 584 are screw-coupled to angle holes (740 of FIG. 22) and angle fixing holes 588, the supporting angle 580 supports the right-front end load of the main drain pan 700.

The base pan 500 is provided at a left-top surface with a unit seating part 503. An outdoor blower unit 600 is fitted in the unit seating part 503. It is concaved to have a protrusion corresponding to a cross-section of the lower end of the outdoor blower unit 600.

Figure 14:
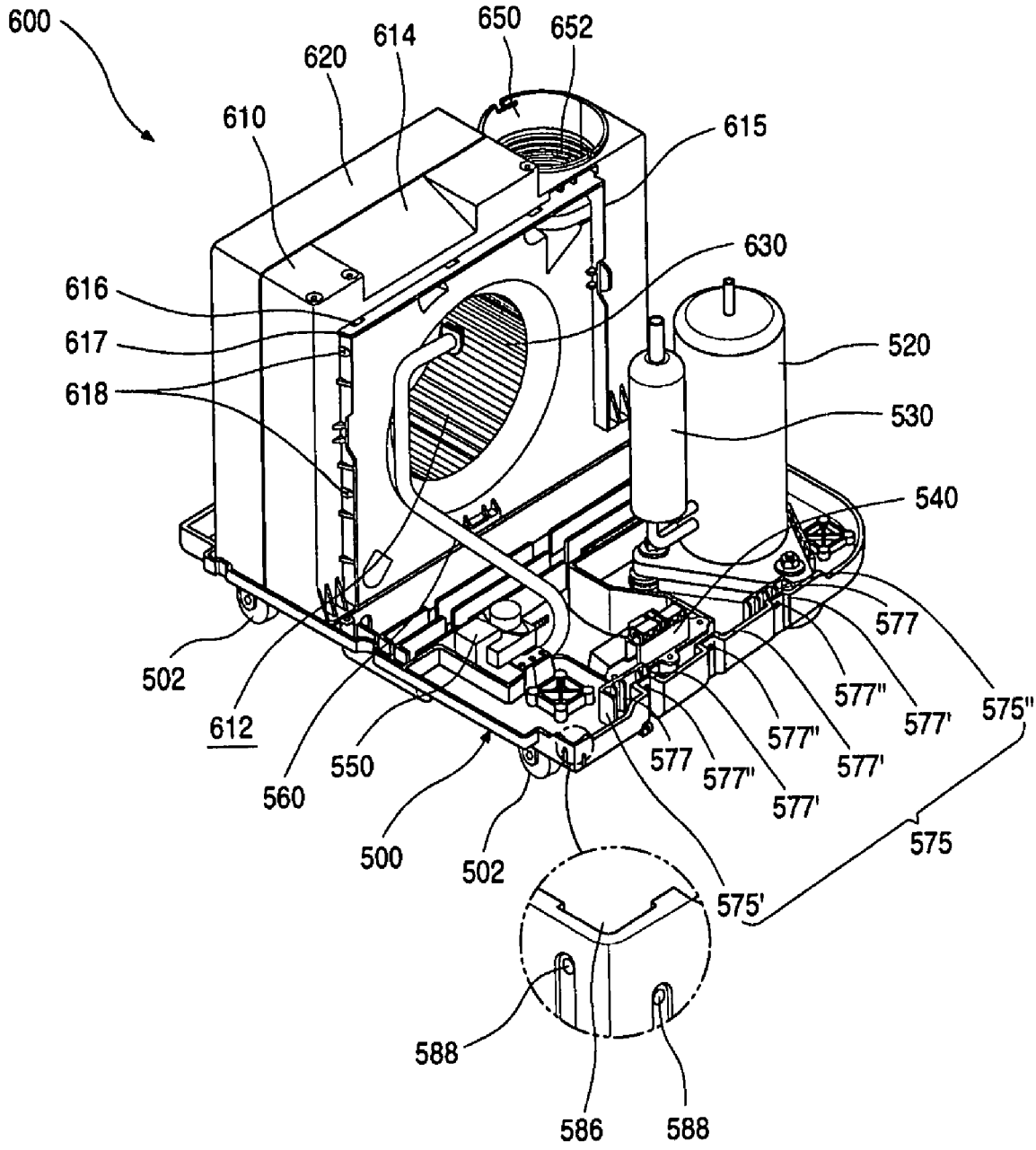
FIGS. 14 and 15 are respectively front and rear perspective views illustrating an outdoor blower unit mounted on a base pan according to an embodiment of the present invention.

Accordingly, when the outdoor blower unit 600 is inserted in the unit seating part 503, the outdoor blower unit 600 maintains it elected state on the top surface of the base pan 500 (see FIG. 14).

A cord fixing member 590 is provided on a top-rear part of the base pan 500. The cord fixing member 590 is provided to fix a power cord (C of FIG. 13) for supplying electric power to each component. The cord fixing member 590 is fixed on a cord seating part 504 elevated upward from the base pan 500 to partly receive the power cord C. The cord fixing member 590 fixes the power cord C by pressing an outer surface of the power cord C.

Therefore, even when an pulling force is applied to the power cord C exposed to an external side of the air conditioner, the power cord C is not further drawn out. The cord fixing member 590 and the cord seating part 504 will be described in more detail later.

The outdoor blower unit 600 is provided at a left side of the first heat exchanger 510. The outdoor blower unit 600 generates wind to make air flow. That is, the outdoor blower unit 600 generates suction at a left side to suck the air passing through the first heat exchanger 510 and discharge the sucked air toward a right-upper side.

To this end, the outdoor blower unit 600 includes a lower orifice 610 and a lower air guide 620 that define a housing groove 640, a lower fan 630 generating wind by rotating in the housing groove 640, and a lower motor 660 providing a rotational force to the lower fan 630. The lower orifice 610 supports a plurality of components including a lower blower unit 800 and guides the air passed through the first heat exchanger 510 leftward. Accordingly, a circular lower orifice hole 612 is formed at a central part of the lower orifice 610.

A lower air guide 620 is installed at a left side of the lower orifice 610. The lower air guide 620 guides the air flow together with the lower orifice 610. The lower fan 630 for forcedly generating the airflow is located between the lower orifice 610 and the lower air guide 620. Therefore, the housing groove 640 is defined by the lower orifice 610 and the lower air guide 620 to guide the air flowing by the lower pan 630.

That is, the housing groove 640 are formed by grooves that are respectively formed at a left surface of the lower orifice 610 and a right surface of the lower air guide 620 to guide the air discharged by the lower fan 630. The housing groove has a diameter greater than an outer diameter of the lower fan 630 to enclose the lower fan 630.

Exhaust guides 650 corresponding to each other are further formed on the respective lower orifice and lower air guide 610 and 620. The exhaust guide 650 functions to guide the air from the housing groove 640 to the exhaust guide unit 400. An upper end of the exhaust guide 650 has a shape corresponding to that of a lower end of the exhaust guide unit 400.

A circular exhaust grille 652 is inserted and mounted in an inner-upper end of the exhaust guide 650. The exhaust grille 652 functions to prevent external foreign objects from being introduced through the exhaust guide 650.

A lower motor hole 622 is formed at a central part of the lower air guide 620. Therefore, the lower motor 660 is inserted and fixed in the lower motor hole 622. The lower motor 660 generates a rotational force using an external electric power and supplies the rotational force to the lower fan 630 to rotate the lower fan 630.

A lower motor support 670 is further installed at a left side of the lower air guide 620. The lower motor support 670 is provided to more securely support the lower motor 660 mounted on the lower air guide 620. The lower motor support 670 has a lower end abutting the base pan 500. The coupling relationship of the components of the outdoor blower unit 600 will be described in more detail later.

The main drain pan 700 is installed on a central-rear part of the front frame 100. The main drain pan 700 is formed in a rectangular shape, functioning to collect the condensed water generated from the second heat exchanger 870, support the components, and divide the internal space of the air conditioner into upper and lower halves.

In more detail, the air conditioner is generally divided into indoor and outdoor sides. The main drain pan 700 functions to divide the air conditioner into the indoor and outdoor sides. That is, with respect to the main drain pan 700, the outdoor side (heat discharge side) is formed at a lower half and the indoor side (heat absorption side) is formed at an upper half.

The sub-drain pan 750 is installed under the main drain pan 700. The sub-drain pan 750 is a part for collecting and dispensing the condensed water fed by the condensed pump 550.

In more detail, the sub-drain pan 750 extends in a front-rear direction and is installed at an upper side of the first heat exchanger 510. Therefore, the condensed water collected in the main drain pan 700 is directed to and collected in the sub-drain pan 750. The condensed water fed to the sub-drain pan 750 is uniformly dispensed to the upper end of the first heat exchanger 510 to be vaporized.

The indoor blower unit 800 is installed at an upper side of the main drain pan 700. The indoor blower unit 800 directs the indoor air introduced into the air conditioner through the external air inlet 302 and vertically erects on the top surface of the main drain pan 700.

A front outer appearance of the indoor blower unit 800 is provided with an upper air guide 810 for guiding the air forced by an upper fan 850. The upper air guide 810 is installed across the upper side of the main drain pan 700. The upper air guide 810 is integrally formed with the upper fan housing 820. The upper fan housing 820 is installed to enclose the upper fan 850.

Therefore, the air that is forcedly discharged by the upper fan 850 is guided by the upper fan housing 820 and directed to the discharge guide member 824. The upper motor hole 822 is formed through the upper air guide 810. The upper motor 830 is inserted in the upper motor hole 822. The upper motor 830 provides a rotational force to the upper fan 850.

The discharge guide member 824 is installed through an upper end of the upper air guide 810. The discharge guide member 824 is formed in a rectangular shape corresponding to the discharge louver 110. Therefore, the air guided by the upper fan housing 820 is directed frontward through the discharge guide member 824 and passes through the discharge louver 110.

The upper motor support 840 is further provided at a lower side of the upper motor 830. The upper motor support 840 has an identical function to the lower motor support 670. That is, the upper motor support 840 is provided to more securely support the upper motor 830. Therefore, the upper motor support 840 has a lower end fixed on a front-top surface of the main drain pan 700.

The upper fan 850 is received in the upper fan housing 820. The upper fan 850 is provided to forcedly direction the external air into the air conditioner through the intake grille 310 and is coupled to a rear end of the upper motor 830.

An upper orifice 860 is provided at a rear side of the upper air guide 810. The upper orifice 860 is formed in a rectangular plate and provided with a circular upper orifice hole 862 through which the air flows.

A second heat exchanger 870 is installed at a rear side of the upper orifice 860. The second heat exchanger 870 is provided to allow the air introduced through the intake grille 310 to heat exchange with the refrigerant and installed on a rear half of the main drain pan 700.

Meanwhile, a control box 880 is installed at a right-front end part of the main drain pan 700. The control box 880 is installed in the main drain pan 700 to receive a plurality of electronic components for controlling the operation of the air conditioner. That is, the upper half of the control box 880 protrudes upward from the main drain panel 700 and the lower half protrudes downward from the main drain panel 700.

The structure of the control box 880 will be described in more detail later.

Figure 4:
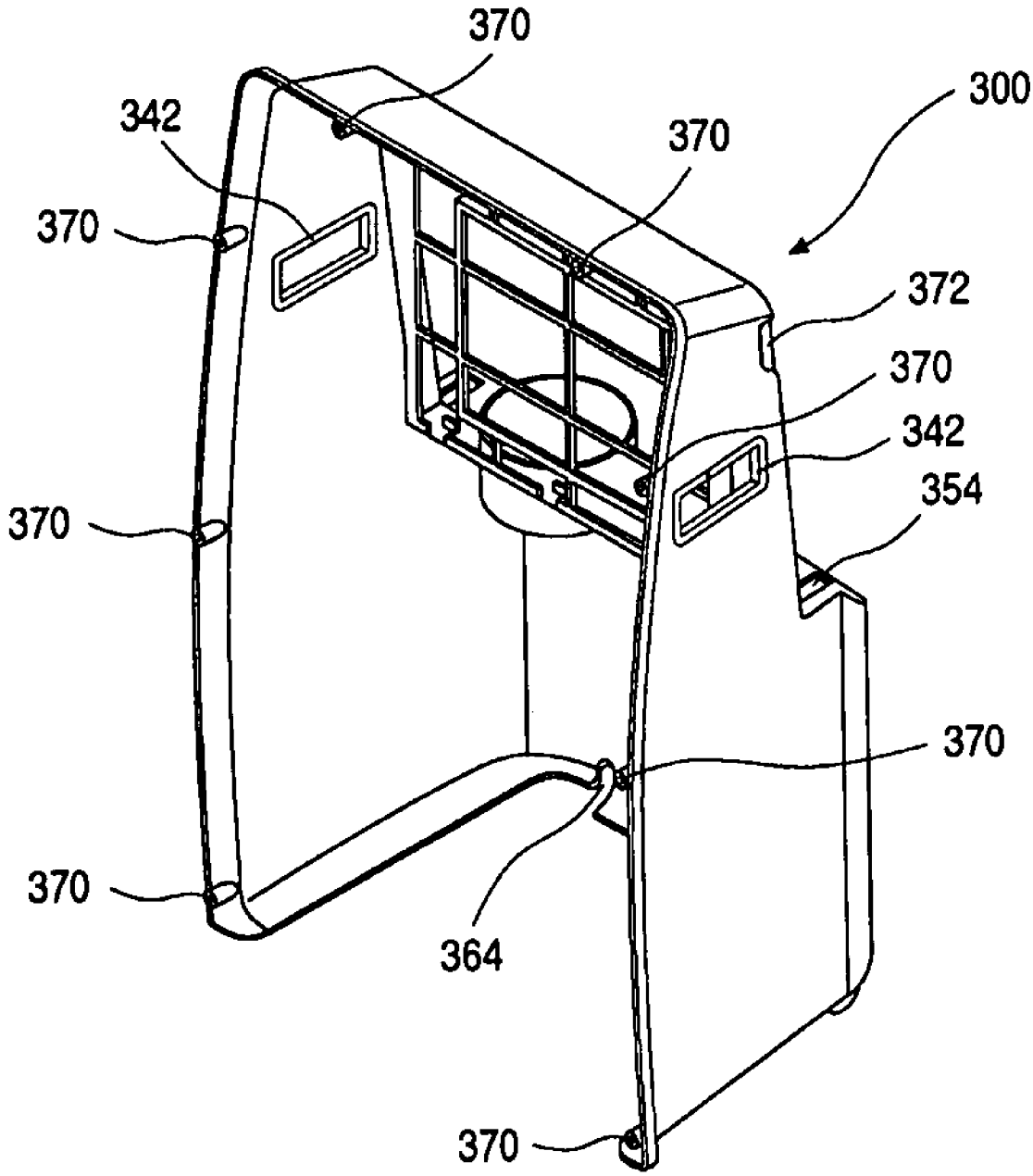
FIGS. 4 and 5 are respectively front and rear perspective views of a rear frame according to an embodiment of the present invention.
Figure 5:
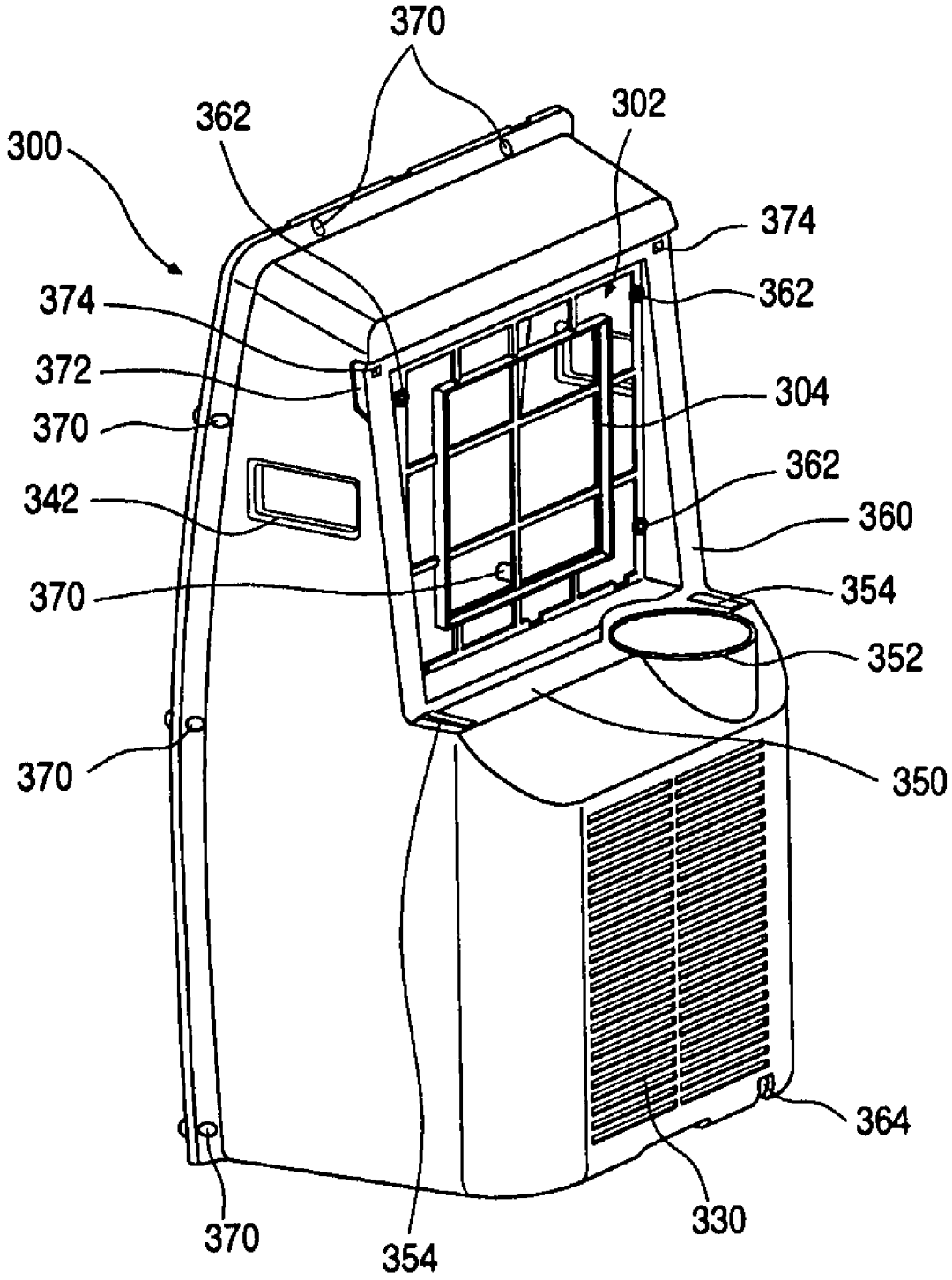

FIGS. 4 and 5 are respectively front and rear perspective views of the rear frame according to an embodiment of the present invention.

Referring to FIGS. 4 and 5, a rear surface of the rear frame 300 is configured to be stepped. That is, lengths of the upper and lower halves of the rear frame 300 are different from each other. The length of the lower half of the rear frame 300 is greater than the length of the upper half of the rear frame 300. Therefore, a stepped surface 350 is formed at a central part of the rear frame 300. That is, the stepped surface 350 is formed at a lower side of the external air inlet 302 formed through the upper half of the rear frame 300.

A duct connection opening 352 is vertically formed at the stepped surface 350. The duct connection opening 352 is a part to which the lower end of the exhaust guide unit 400 is coupled. That is, the frame connector 430 of the exhaust guide unit 400 is installed and inserted in the duct connection opening 352.

Therefore, the duct connection opening 352 is formed in a cylindrical shape corresponding to the lower end of the frame connector 430. Grille projection insertion holes 354 are formed through left and right side ends of the stepped surface 350. The grille projection insertion hole 354 is a part in which the grille coupling projection 317 is inserted.

Meanwhile, the grille mounting part 360 is formed at an upper side of the stepped surface 350. The grille mounting part 360 is a part on which the intake grille 310 is mounted. It is formed in rear of the external air inlet 302.

A plurality of filter fixing hooks 362 on which the pre-filter 320 is mounted on an edge of the external air inlet 302. That is, the filter fixing hooks 362 are formed on the respective four corners of the rear surface of the end of the external air inlet 302 to fix the four corners of the pre-filter.

The lower grills 330 is formed on a lower side of the stepped surface 350. The lower grills 330 may be formed at only right side of the lower half of the rear frame 300. That is, in FIG. 5, although a case the intake grille 310 is formed throughout the lower half of the rear frame 300, the air cannot substantially flow through the left side of the intake grille 310 since it is blocked.

The reason for forming the lower grille 330 on only the right side of the rear frame 300 is to allow the air introduced through the lower grille 330 to pass through the first heat exchanger 510. That is, the air introduced rearward through the lower grille 330 is directed to the right side of the first heat exchanger 510 and is then directed to the left side of the first heat exchanger 510.

A piping hole 364 is formed through the lower end of the rear frame 300. The piping hole 364 is a part where a discharge pipe (not shown) for guiding the discharge of the condensed water is installed.

The plurality of frame coupling projections 370 for the coupling to the front frame 100 are formed on a front end of the rear frame 300. The frame coupling projections 370 are parts through which a coupling member such as screws penetrate. The frame coupling projections 370 are formed on left and right side ends and upper end of the rear frame 300.

That is, the frame coupling projections 370 are formed on centers and upper and lower ends of the left and right ends and left and right sides of a front surface of the upper end of the rear frame 300. Therefore, the screws are inserted in the frame coupling projections 370 to realize the coupling of the rear frame 300 to the front frame 100. Meanwhile, removal grooves 372 are formed on upper-rear side ends of the rear frame 300. The removal grooves 372 are concaved inward from the both sides of the rear frame 300. A vertical length of the removal grooves 372 is designed to almost correspond to a length of a hand of the human being.

The removal grooves 372 are provided to prevent the interference with the hands when the user grasps removal ribs 315 to pull the removal rib 315 of the intake grills 310 frontward.

Grille hook coupling holes 374 are formed in the upper end of the rear frame 300. Grille coupling hooks 316 are inserted in the grille hook coupling holes 374.

The grille hook coupling holes 374 are formed in left and right sides of the upper end of the grille mounting part 360.

The grille hook coupling holes 374 are sized such that hook parts 316' of the grille coupling hooks 316 can be inserted therein.

Figure 6:
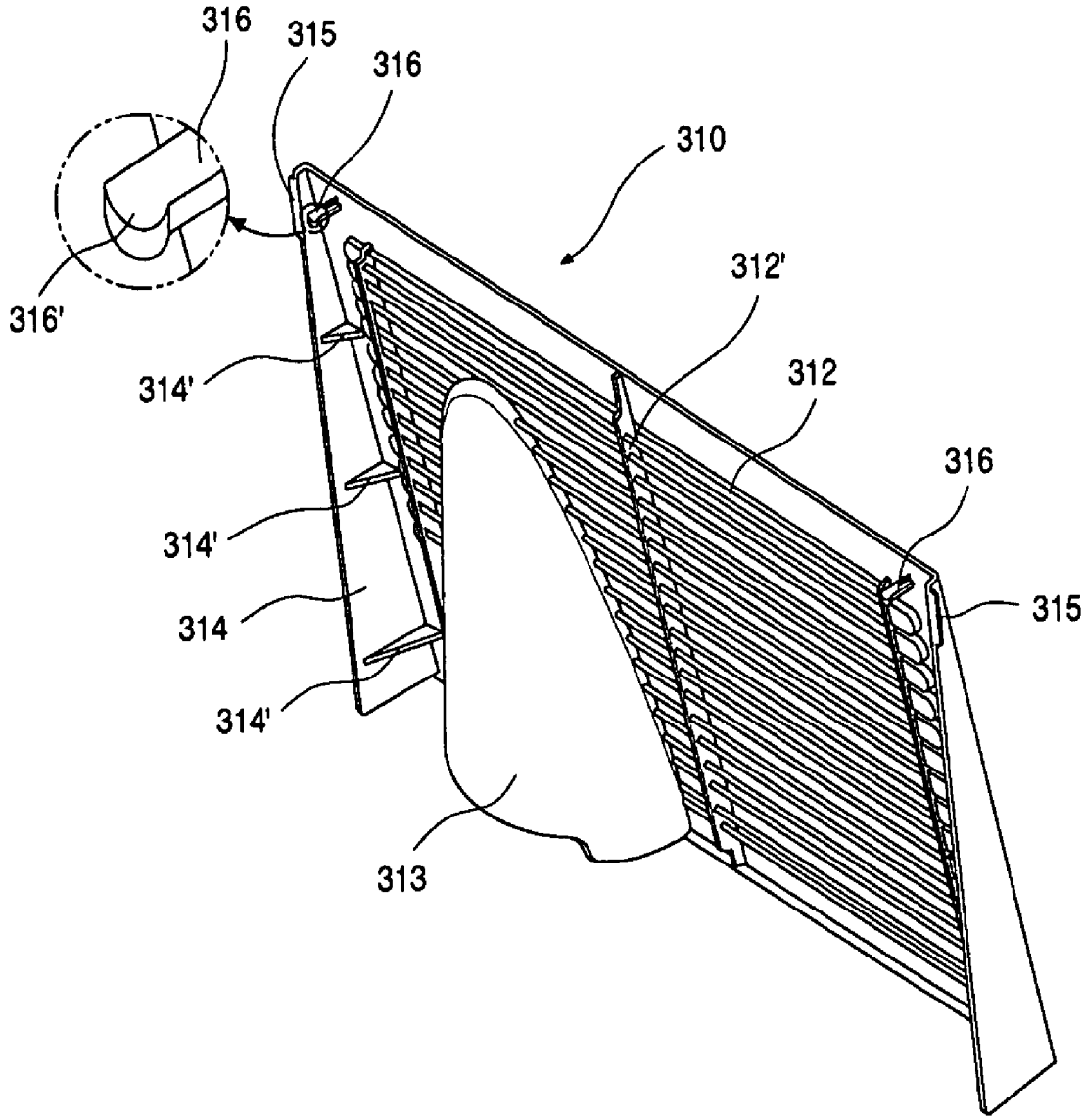
FIGS. 6 and 7 are respectively front and rear perspective views of a intake grille according to an embodiment of the present invention.
Figure 7:
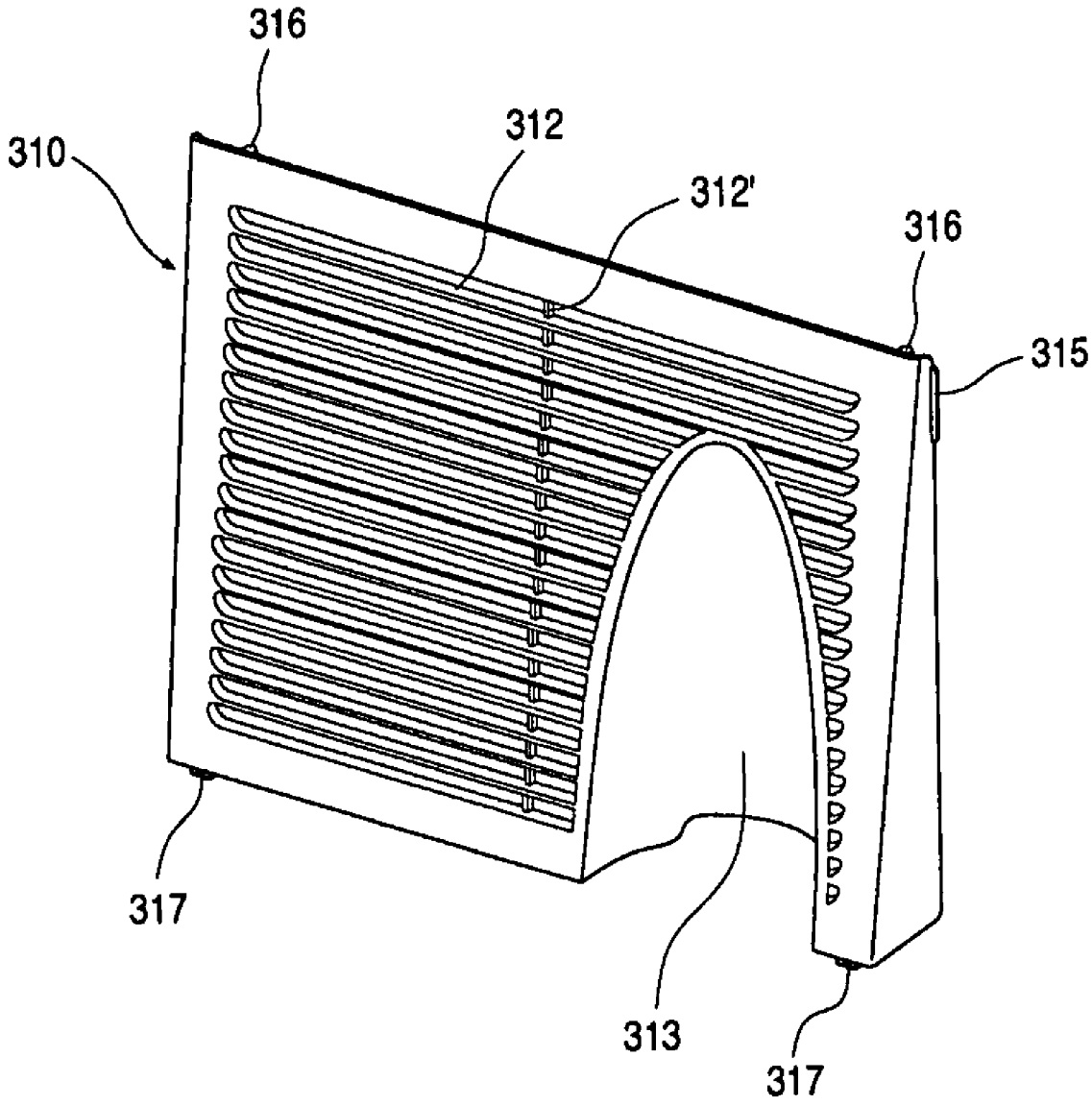

FIGS. 6 and 7 are respectively front and rear perspective views of the intake grille according to an embodiment of the present invention.

Referring to FIGS. 6 and 7, a plurality of grille ribs 312 are formed on the intake grille 310 at a predetermined equal interval so that the air flows between the grille ribs 312.

Gaps between the grille ribs 312 may be blocked by a net or mesh to prevent external foreign objects from introducing.

A rib support 312' is vertically formed at a central part of the intake grille 310. The rib support 312' functions to support the intake grille 310.

The intake grille 310 is provided with duct receiving groove 313 for partly receiving the exhaust guide unit 400. That is, the intake grille 310 is provided at a left part with the duct receiving groove 313 concaved frontward. A lower end of the duct receiving groove 313 is formed in a semi-circular shape corresponding to the front surface of the exhaust duct 410. Therefore, the front ends of the exhaust duct 410 and the frame connector 430 are received in the duct receiving groove 313.

The intake grille 310 is inclined frontward. Therefore, both ends of the intake grille 310 are bent frontward and extend so as to define a grille side surface part 314 that is triangular-shaped a width of which is gradually increased as it goes downward. Grille reinforcing ribs 314' are formed on an inner side of the grille side surface part 314 to reinforce the supporting strength.

A removal rib 315 is further formed on the upper end of the intake grille 310 to provide the removal convenience. That is, the removal rib 315 protrudes from the upper end of the grille side surface part 314. Therefore, when the user pulls the removal rib 315 rearward, the upper end of the intake grille 310 is separated from the rear frame 300.

A pair of grille coupling hooks 316 are formed on the upper end of the intake grille 310. The grille coupling hooks 316 are parts by which the upper end of the intake grille 310 is coupled to the rear frame 300. The grille coupling hooks 316 protrude from the left and right upper ends frontward.

The grille coupling hooks 316 are designed to have a self-elastic force so that front ends thereof can move by a predetermined distance and be returned to their initial positions. Hook parts 316' are formed on the front ends of the grille coupling hooks 316.

Therefore, after the grille coupling hooks 316 are inserted into the grille hook coupling holes 374 of the rear frame 300, the grille coupling hooks 316 are not removed from the grille hook coupling holes 374 due to the hook parts 316' unless applying predetermined external force.

A grill coupling projections 317 are further formed on a lower end of the intake grill 310. The grille coupling projections 317 are a part inserted into the grille projection insertion hole 354. Therefore, they protrude from left and right lower end of the intake grille 310 and are sized to correspond to the widths of the grille projection insertion holes 354.

The following will describe the cord fixing member 590 with reference to FIGS. 8 through 13.

Figure 8:
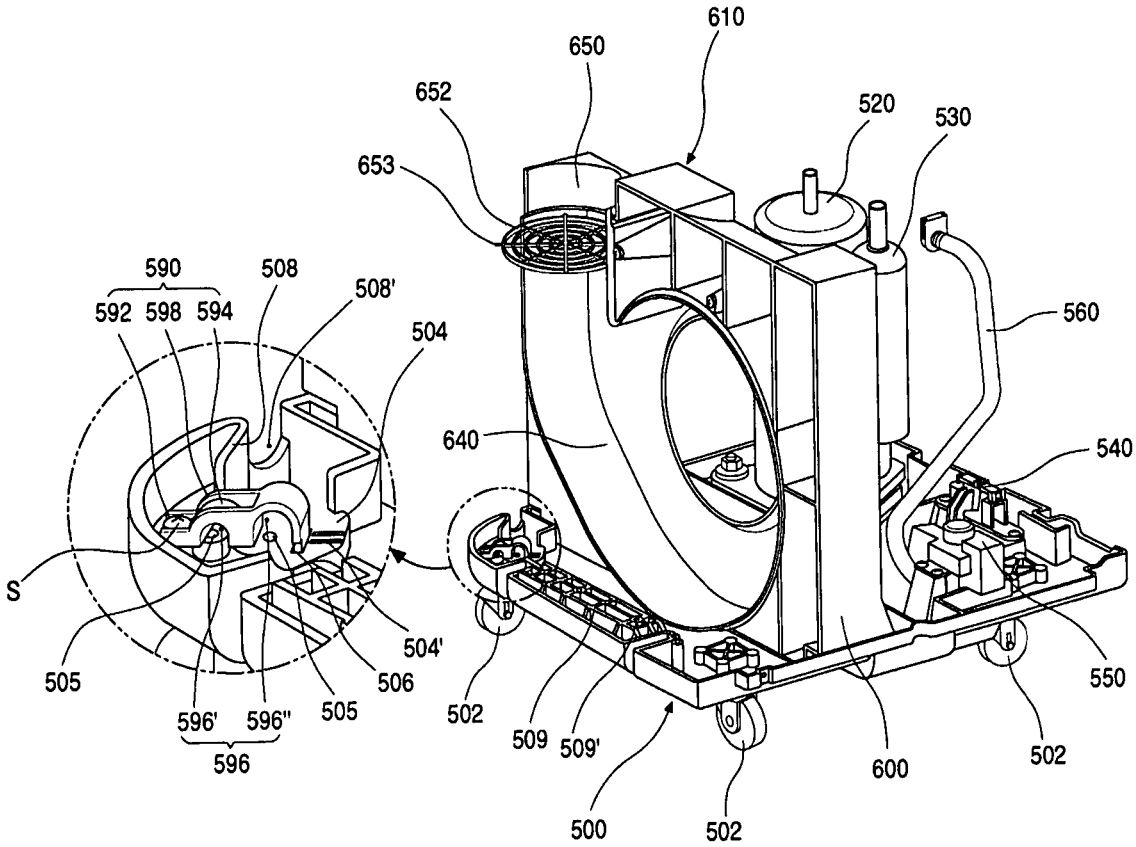
FIG. 8 is a perspective view illustrating a cord fixing member coupled to a base pan according to an embodiment of the present invention.
Figure 9:
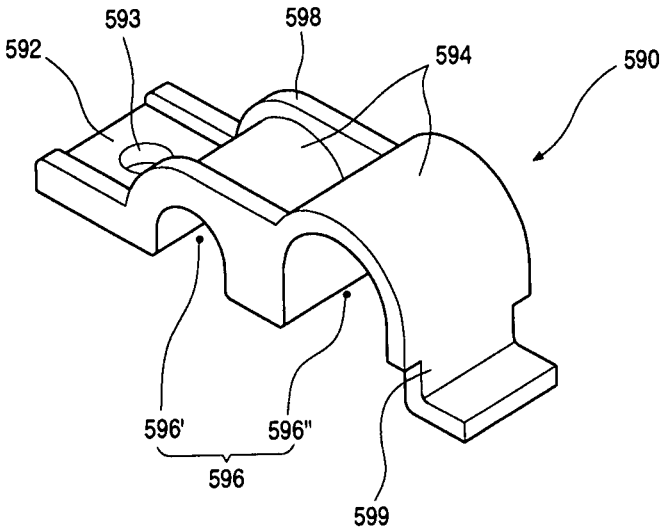
FIGS. 9 and 10 are top and bottom perspective view of a cord fixing member according to an embodiment of the present invention.
Figure 10:
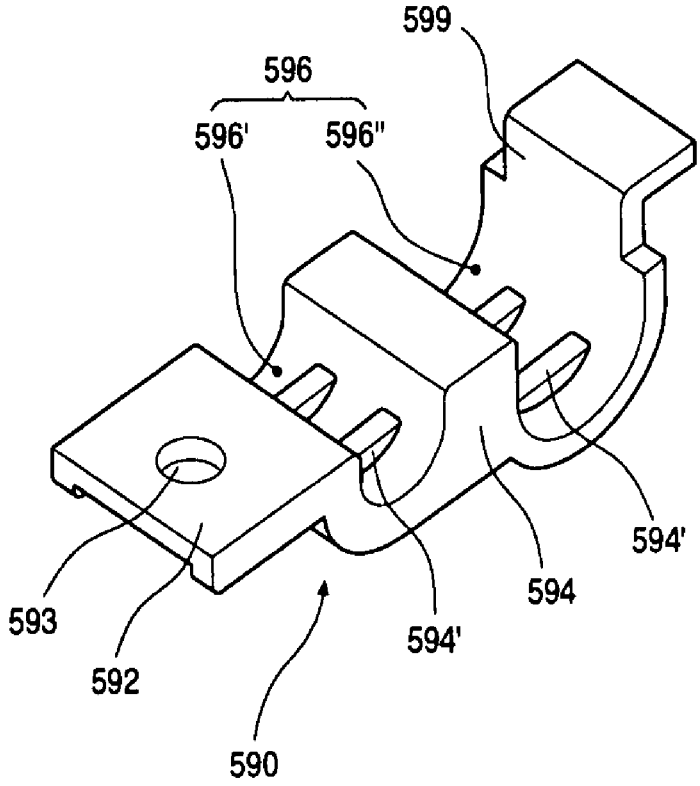
Figure 11:
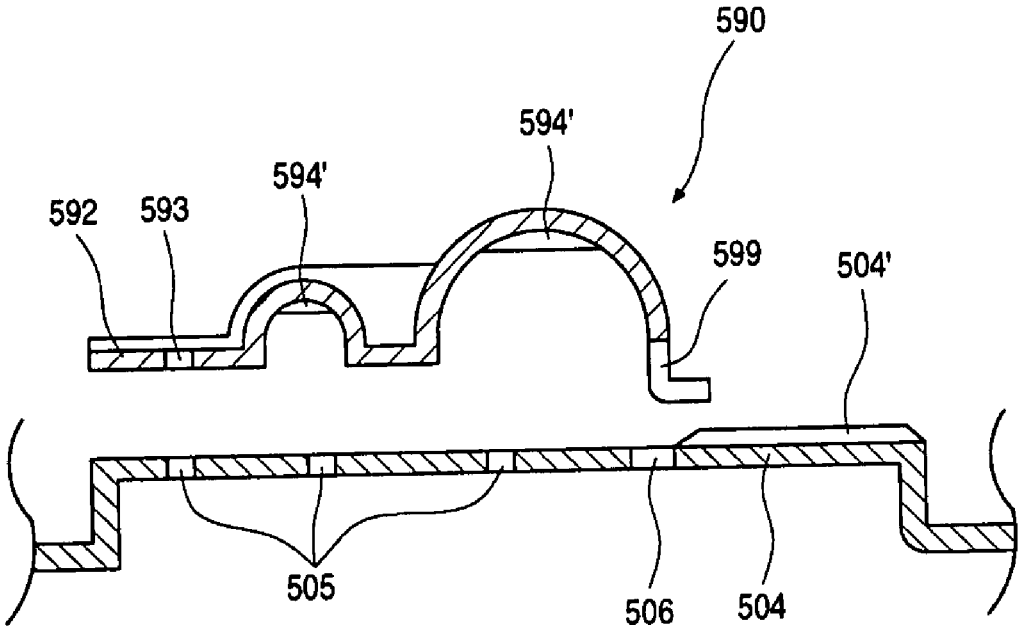
FIGS. 11 through 13 are longitudinal sectional view illustrating a process for assembling a cord fixing member according to an embodiment of the present invention.

As shown in FIG. 8, the cord fixing member 590 is coupled to the top surface left corner of the base pan 500 by a coupling member S. The cord seating part 504 on which a bottom of the cord fixing member 590 is seats protrudes from the tops surface of the base pan 500.

The cord fixing member 590 is fixedly coupled to the top surface of the cord seating part 504 by the coupling member S. At this point, the cord fixing member 590 is configured to press the outer surface of the power cord C.

In more detail, the cord seating part 504 is provided at the top surface with coupling holes 505 concaved downward and fixing the coupling member S and hook holes 506 in which an end of the cord fixing member 590 is inserted and hooked.

The fixing member coupling holes 505 are parts to which the coupling member S is coupled. The fixing member coupling holes 505 are formed on the top surface of the cord seating part 504 at predetermined intervals.

Therefore, the cord fixing member 590 is selectively coupled to one of the fixing member coupling holes 505. Therefore, the coupling location of the cord fixing member 590 may be varied.

A pair of seating part reinforcing ribs 504' are formed on the right-top surface of the cord seating part 504 spaced apart from the fixing member coupling holes 505. The seating part reinforcing ribs 504' are provided to prevent the deformation of the cord seating part 504 when fixing member hook projections (599 of FIG. 9) are fixedly inserted in the fixing member hook holes 506. The seating part reinforcing ribs 504' are spaced apart from each other in parallel.

A cord guide 508 is provided on a rear side of the cord seating part 504. The cord guide 508 is elevated by a predetermined height from the top surface of the base pan to divide the upper space of the base pan 500. The draw of the power cord C partly fixed by the cord fixing member 590 out of the air conditioner is guided by the cord guide 508.

That is, a front end of the cord guide 508 is opened toward a location where the cord fixing member 590 is located. A cord exposure groove 508' is formed on a rear end of the cord guide 508 to allow the power cord C can be exposed to an external side of the air conditioner.

Therefore, the power cord C located in rear of the cord fixing member 590 is guided to the cord exposure groove 508' by the cord guide 508 and thus exposed to the external side of the air conditioner.

The cord fixing member 590 seats on the cord seating part 504, including a coupling plate 592 coupled to the fixing member coupling holes 505 and a receiving part 594 formed and rounded at a right end of the coupling plate 592 for receiving the power cord C.

The coupling plate 592 is generally formed in a rectangular shape and coupled to the coupling member S. The bottom surface of the coupling plate 592 maintains a contact state with the top surface of the cord seating part 504.

To this end, the coupling plate 592 is provided at a center with a coupling hole (593 of FIG. 9) that cooperates with one of the fixing member coupling holes 505 to vary the coupling location of the cord fixing member 590.

The receiving part 594 is integrally formed with the coupling plate 592. The receiving part 594 define a plurality of receiving spaces 596 in which the power cord C is received. The receiving spaces 596 is designed to receive a variety of thickness of the power cord C. That is, the receiving spaces 596 include a first receiving space 596' formed on a left side of the receiving part 594 and a second receiving space 596" formed at a right side of the first receiving space 596' and having a curvature greater than that of the first receiving space 596'.

Therefore, according to the thickness of the power cord C the power cord C may be selectively received in one of the first and second receiving spaces 596' and 596".

That is, the cord fixing member 590 may be formed in a variety of shapes depending on the shape of the power cord C applied. For example, when the power cord C having a rectangular section is used, the receiving space 596 may be designed having the rectangular shape.

Needless to say, the power cord C may be inserted in both of the first and second receiving spaces 596' and 596".

A pair of pressing projections 594 are provided on ceilings of the first and second receiving spaces 596' and 596" to press the outer circumference of the power cord C received therein, thereby preventing the power cord C from being drawing out in a front-rear direction. The pressing projections 594 are spaced apart from each other in parallel.

Fixing member reinforcing ribs 598 are provided on front and rear ends of the top surface of the cord fixing member 590 to prevent the cord fixing member 590 from being deformed and damaged in advance.

That is, the power cord C is inserted in the receiving space 596 in a state where the bottom surface of the cord fixing member 590 contacts the cord seating part 504. At this point, the power cord C is applied with pressing force by the pressing projections 594'.

The cord fixing member 590 is applied with a vertical force (counterclockwise force) with reference to the coupling hole 593. In this case, the cord fixing member 590 may be deformed and damaged. Therefore, it is desirable that the fixing member reinforcing rib 598 is formed on the top surface of the cord fixing member 590.

The cord fixing member 590 is designed not to rotate frontward and rearward at its right part with reference to the coupling hole 593. That is, a "ㄴ"-shaped fixing member hook projection 599 is formed on the right end, i.e., a right side lower end of the second right space.

The fixing member hook projection 599 is fitted in the fixing member hook hole 506, having a length corresponding to that of the fixing member hook hole 506 and a thickness less than a width of the fixing member hook hole 506.

Figure 12:
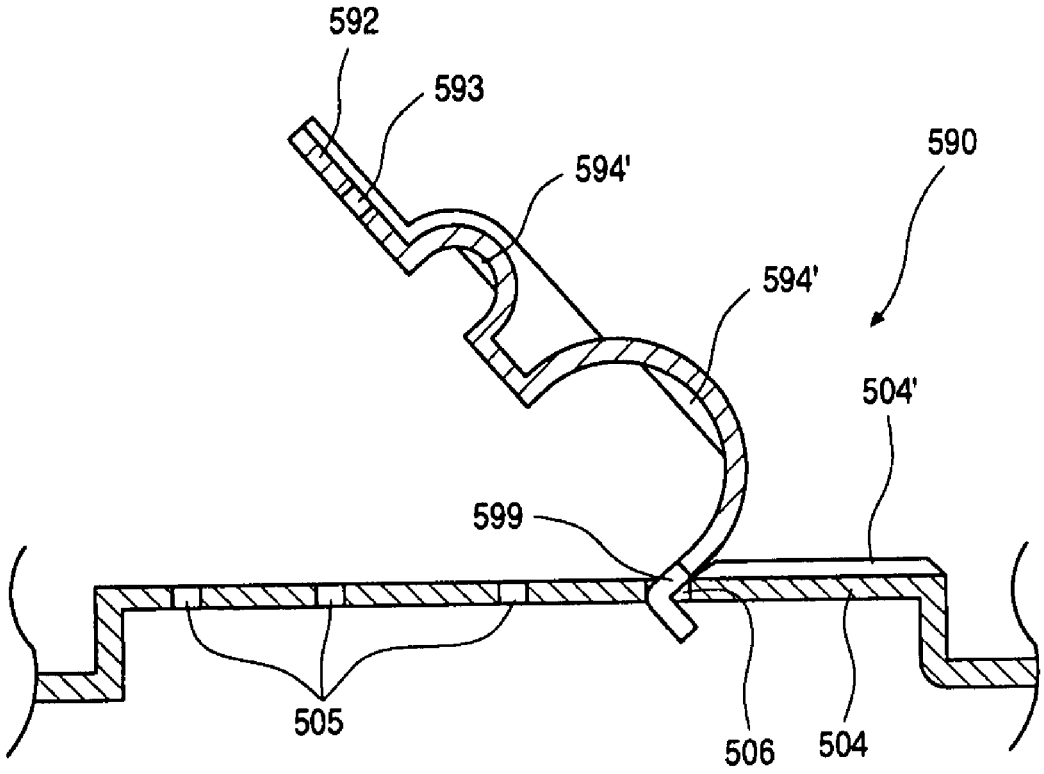
Figure 13:
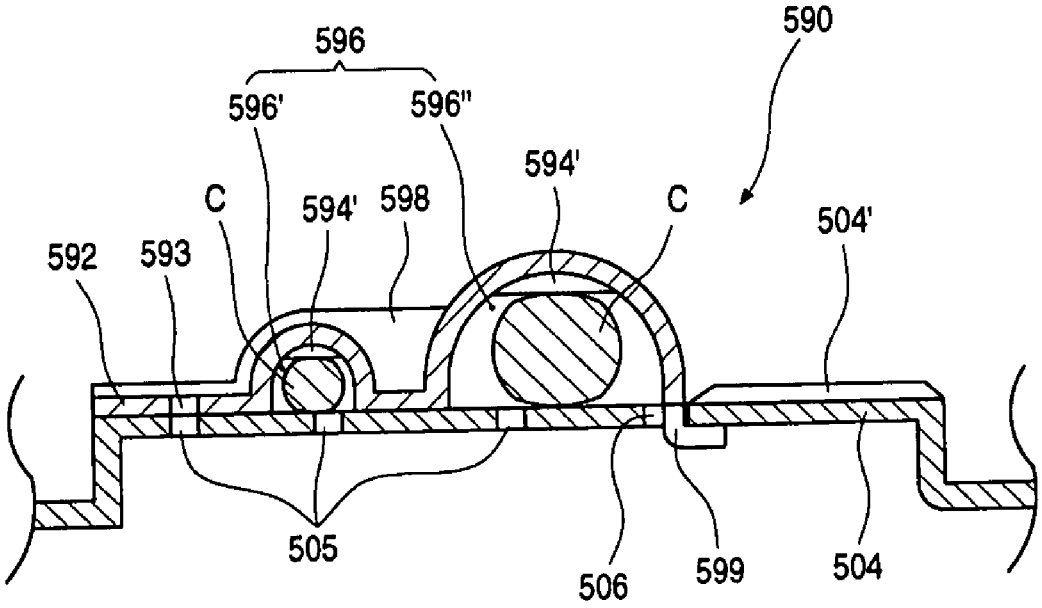

Therefore, the cord fixing member 590 is fixedly hooked as shown in FIG. 13 after the fixing member hook projection 599 is inserted in the fixing member hook hole 506 and rotates counterclockwise in a state where the cord fixing member 590 is inclined as shown in FIG. 12.

Figure 19:
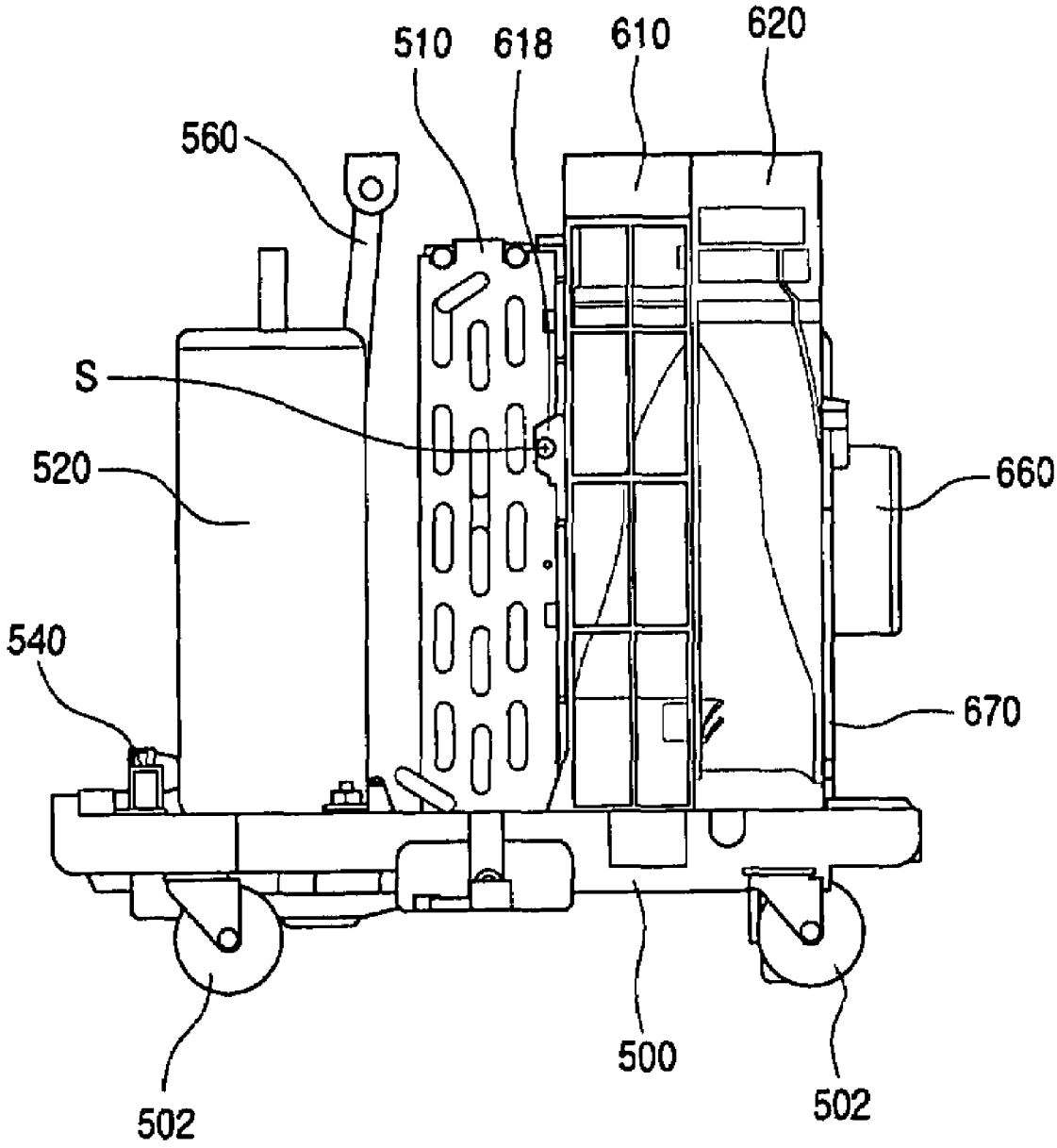

The following will describe the assembling of the components of the outdoor blower unit 600 with reference to FIGS. 14 and 19.

As shown in the drawings, the outdoor blower unit 600 is formed in a rectangular parallelepiped shape by the lower orifice 610 and the lower air guide 620 that are coupled to each other. A space is defined in the outdoor blower unit 600 by the housing grooves 640 that are symmetrically formed on the lower orifice 610 and the lower air guide 620. The lower fan 630 is provided in the space.

The outdoor blower unit 600 is seats on the unit seating part 503 to maintain its erection state on the base pan 500. The outdoor blower unit 600 is securely fixed on the base pan 500 by the lower end corners fixed by the coupling members.

Therefore, when the insertion part 602 is inserted in the unit seating part 503, the front, rear, left, and right surfaces of the insertion part 602 contact the inner surface of the unit seating part 503.

The outdoor blower unit 600 is designed to support the loads of the main and sub-drain pans 700 and 750. That is, the outdoor blower unit 600 is provided with the drain seating groove 614 on which a bottom of the main drain pan 700 is partly disposed. The outdoor blower unit 600 is provided at a front surface with a "ㄇ"-shaped coupling flange 615.

That is, the drain seating groove 614 is concaved to have a curvature corresponding to a protruding part (see FIG. 3) protruding downward from the bottom surface of the main drain pan 700, thereby supporting the load of the main drain pan 700.

An end part of the bottom surface of the sub-drain pan 750 is coupled to a top surface of the coupling flange 615 to be supported by the coupling flange 615. That is, the coupling flange 615 is provided at the top surface with hook holes 616 and the sub-drain pan 750 is provided at the front end with a pair of coupling hooks 752.

The coupling hooks 752 are rectangular plates spaced apart from each other. A distance between the front and rear surfaces of the coupling hook 752 corresponds to a width of the hook hole 616. A hook projection 754 extends from a lower end of a rear surface of the coupling hook 752.

Therefore, when the coupling hooks 752 are inserted into the hook holes 616, the hook projections 754 penetrate the hook hole 616 and are fixed. Therefore, the sub-drain pan 750 is supported on the top surface of the coupling flange 615.

The top surface of the coupling flange 615 is inclined downward as it goes rearward so that the condensed water flowing along the bottom surface of the sub-drain pan 750 ca falls down through the hook hole 616. That is, in a state where the sub-drain pan 750 is fixedly coupled to the coupling flange 615, when the condensed water falls from the sub-drain pan 750 to the first heat exchange 510, a part of the condensed water falling flows rearward along the bottom surface of the sub-drain pan 750 and is introduced into the top surface of the coupling flange 615. In order to direct the condensed water rearward, the top surface of the coupling flange 615 is inclined.

Therefore, the hook hole 616 may be formed at the rear end of the top surface of the coupling flange 615.

A falling water guide 617 protrudes from a left end part of the top surface of the coupling flange 615. The falling water guide 617 is provided to prevent the condensed water flowing rearward along the top surface of the coupling flange 615 from falling leftward.

Therefore, the condensed water collected on the top surface of the coupling flange 615 can fall only through the hook hole 616. When an amount of the condensed water collected on the top surface of the coupling flange 615 increases not to be drained through the hook hole 616, the condensed water is guided by the falling water guide 617 to fall to the first heat exchanger 510.

Meanwhile, the coupling flange 615 functions to prevent the movement of the first heat exchanger 510 by receiving and fixing a surface of the first heat exchanger 510. That is, the coupling flange 615 has a size corresponding to the first heat exchanger 510 and coupling parts 618 are formed on left and right side surfaces of the coupling flanges 615.

The coupling parts 618 are coupled to the side surfaces of the first heat exchanger 510 by coupling members. The coupling parts 618 are formed at many locations on upper and lower parts of the left and right side surfaces of the coupling flange 615. A plurality of holes (not shown) are formed on the side surfaces of the first heat exchanger 510 to correspond to the coupling part 618.

Therefore, the coupling parts 618 is coupled to the holes by the coupling members S, the outdoor blower unit 600 is fixedly coupled to the first heat exchanger 510. The coupling flange 600 is provided at the inner surface with a plurality of spacing projections (619 of FIG. 16) extending to abut the front surface of the lower orifice 610. The spacing projection 619 support the first heat exchanger 510 such that the first heat exchanger 510 maintains a spaced state from the lower orifice 610. A front end of the spacing projections 619 is designed to contact the first heat exchanger 510.

Therefore, when the first heat exchanger 510 is inserted in the coupling flange 615, the first heat exchanger 510 contacts the spacing projections 619 to be spaced apart from the front surface of the lower orifice 610. By the coupling parts 618 coupled to the hole by the coupling members, the first heat exchanger 510 is fixed in a state where it is spaced apart from the outdoor blower unit 600. Meanwhile, the exhaust grille 652 is provided in the exhaust guide 650 provided with the grille fixing grooves 64 for fixing the exhaust grille 652.

The grille fixing grooves 654 receives a part of the outer circumference of the exhaust grille 652 to prevent the vertical movement of the exhaust grille 652. The exhaust grille 652 is provided at the outer circumference with a plurality of grille projections 653 for allowing the exhaust grille 652 to be fixed in the grille fixing groove 654. The grille projections 653 are formed to correspond to the grille fixing groove 654. The assembling of the lower orifice 610 with the lower air guide 620 is performed by fitting the lower orifice 610 as shown in FIG. 8.

Figure 15:
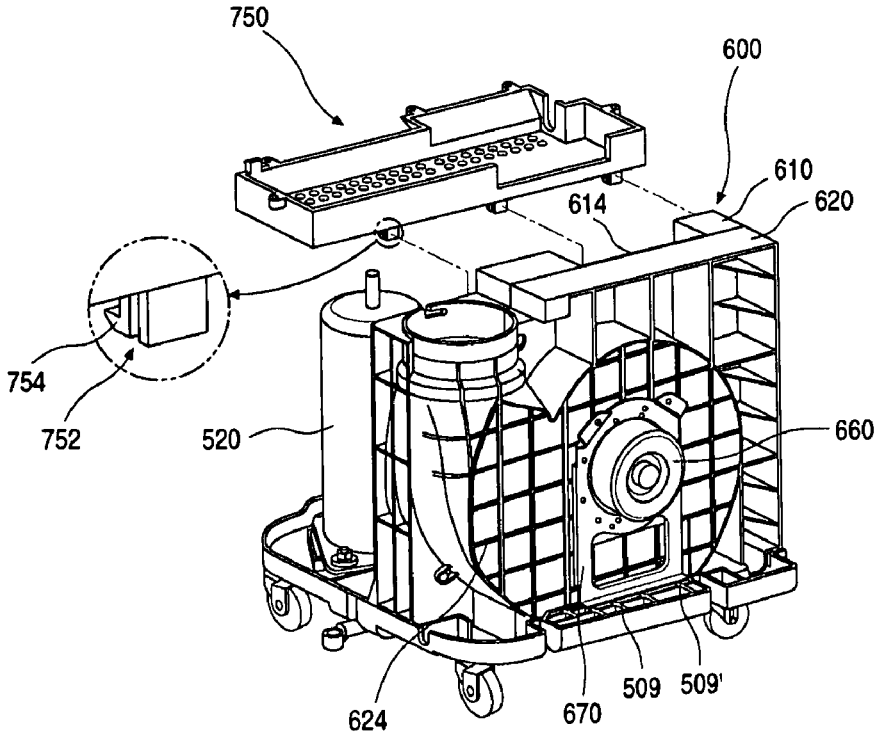

Describing the outer structure of the lower air guide 620 with reference to FIG. 15, the reinforcing rib 624 formed in a lattice shape extends from the from surface of the lower air guide 620. The reinforcing rib 624 reinforces the front thickness of the lower air guide 620 to enhance the strength of the lower air guide 620.

The lower motor 660 and the lower motor support 670 are coupled to the front surface of the lower air guide 620. The lower motor support 670 receives the lower motor 660 at its upper part and the lower end of the lower motor support 670 seats on the top surface of the base pan 500.

Therefore, the top surface of the base pan 500 contacting the bottom surface of the lower motor support 670 supports the load of the lower motor 660 that is relatively heavy. Therefore, there is a need for a structure for enduring the heavy lower motor 660.

That is, the support seating part 509 are formed extending from a front half of the top surface of the base pan 500. The support seating part 509 is larger than the lower motor support 670 to support the load of the lower motor 660.

The support seating part 509 is provided with a plurality of support coupling grooves (509' of FIG. 8). The support coupling grooves 509' are parts to which the coupling members penetrating the lower end of the lower motor support 670 are coupled for the coupling of the lower motor support 670 to the base pan 500.

A plurality of support coupling grooves 634' are provided on a front central part of the lower air guide 620 around the lower motor hole 622. The support coupling grooves 634' provide a place where the lower motor support 670 is coupled to the lower air guide 620 and are arranged along a concentric circle with the lower motor hole 622.

Therefore, when the support coupling grooves 624' and the support coupling grooves 509' are coupled to the upper part and lower end of the lower motor support 670, the front surface of the outdoor blower unit 600 is completely fixed on the base pan 500.

Meanwhile, the base panel 500 is provided at the top surface with a structure for fixing the support angle 580 and the lower part of the brace 570 on the base pan 500.

That is, as shown in FIG. 14, the base pan 500 is provided at a right end corner with an angle seating groove 586 concaved forward. The lower end of the support angle 580 seats on the angle seating groove 586, corresponding to the cross-section shape of the support angle 580.

A pair of angle fixing holes 588 are formed through the front and right side of the angle seating groove 586. The base coupling parts 584 are coupled to the angle fixing holes 588 by a coupling member such as a screw. That is, like the base coupling parts 584, the angle fixing holes 588 are formed such that the angle fixing hole 588 formed on the front side is higher than the angle fixing hole 588 formed on the right side.

Therefore, when the lower end of the support angle 580 is inserted in the angle seating groove 586, the base coupling parts 584 and the angle fixing holes 588 are concentrically arranged so that they can be interlocked by the coupling members.

Brace supports 575 extend from the front and rear parts of the right top surface of the base pan 500 to support the lower end of the brace 570.

That is, the brace support 575 includes a brace front end support part 575' for fixing the front end lower side of the brace 570 and a brace rear end support part 575" for fixing the rear end lower part. The brace front end support part 575' and the brace rear end support part 575" are symmetrical each other.

In more detail, when viewed from the top, the brace front end part 575' is formed in a "L"-shape and the brace rear end support part 575" is formed in "⌐"-shape. Therefore, The lower end of the brace 570, i.e., the base fitting part 578 is inserted in the right side spaced apart from the longitudinal direction where the brace front end support part 575' and the brace rear end support part 575 are formed.

A plurality of seating guides 577 are provided on a right surface of the brace support 575. The seating guides 577 provide the easy insertion of the brace 570 into the right side of the brace support part 575 and guide the seating position of the brace 570.

That is, the seating guides 577 protrude from the right surface of the brace support part 575 rightward and are spaced apart from each other in a front-rear direction. Each of the seating guides 577 increases in its width as it goes from the upper end of the brace support part 575 downward. That is, the right end of the seating guide 577 is inclined. A distance from the right end of the seating guide 577 to a right surface of the base pan 500 increases as it goes upward from the bottom surface of the base pan 500. Therefore, when the base fitting part 578 of the brace 580 is inserted in the right side of the seating guide 577, the interference can be minimized. During the insertion, the lower end of the base fitting part 578 is guided along the inclined right end of the seating guide 577 to seat on the top surface of the base pan 500.

A plurality of brace contact parts 577' concaved leftward and having a rectangular shape are provided on the right surface of the base pan 500. The brace contact part 577' has an upper end contacting the upper part of the brace coupling part 579 to support the load of the brace 570.

That is, two brace contact parts 577' are formed at right sides of the brace support part 575' and one brace contact parts 577' are formed between the two brace contact parts 577'. That is, total three brace support parts are provided.

A height of the brace contact part 577' corresponds to that of the brace coupling part 579. Therefore, when the brace coupling parts 579 contact the top surface of the base pan 500, the brace contact parts 577' contact the bottom surface of the brace coupling part 579 to support the brace 570.

The brace contact part 577' is provided with a, structure for locking the brace fitting part 578 fitted between the brace support part 575 and the brace contact part 577'. That is, the brace contact part 577' is provided at the right surface with a brace fixing part 577".

The brace fixing part 577" guides the insertion of a coupling member. A left end of the inserted coupling member is coupled to the brace coupling part 579 of the brace 570.

In addition, when the brace 570 is coupled by the coupling member and contacts the left surface of the brace contact part 577', the left surface of the brace 570 should not be spaced apart from the seating guide 577.

That is, the left surface of the brace contact part 577' is designed such that a distance from the left surface thereof to the right surface of the lower end of the seating guide 577 corresponds to the thickness of the brace coupling part 579.

Figure 20:
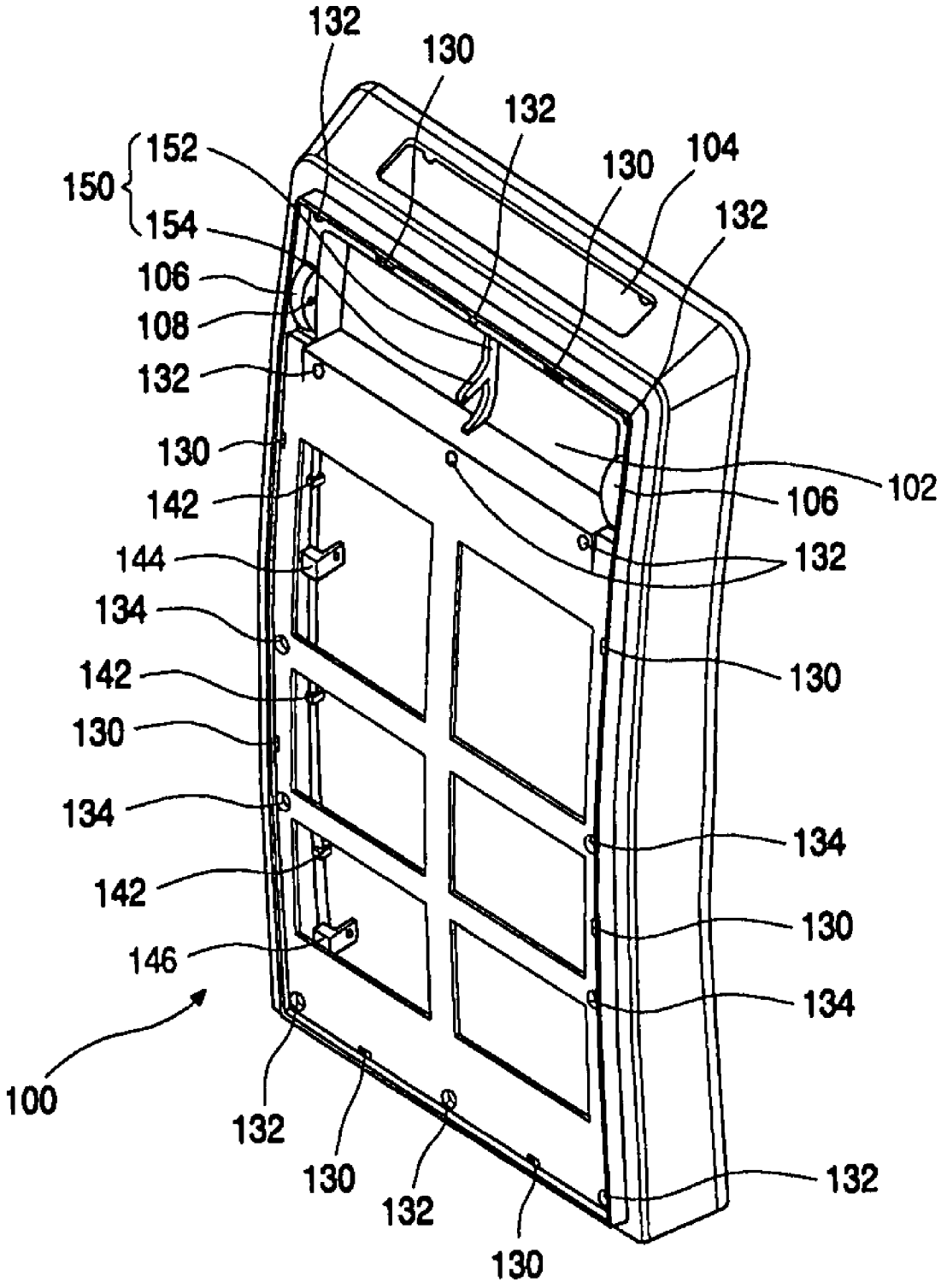
FIGS. 20 and 21 are front and rear perspective view of a front frame according to an embodiment of the present invention.
Figure 21:
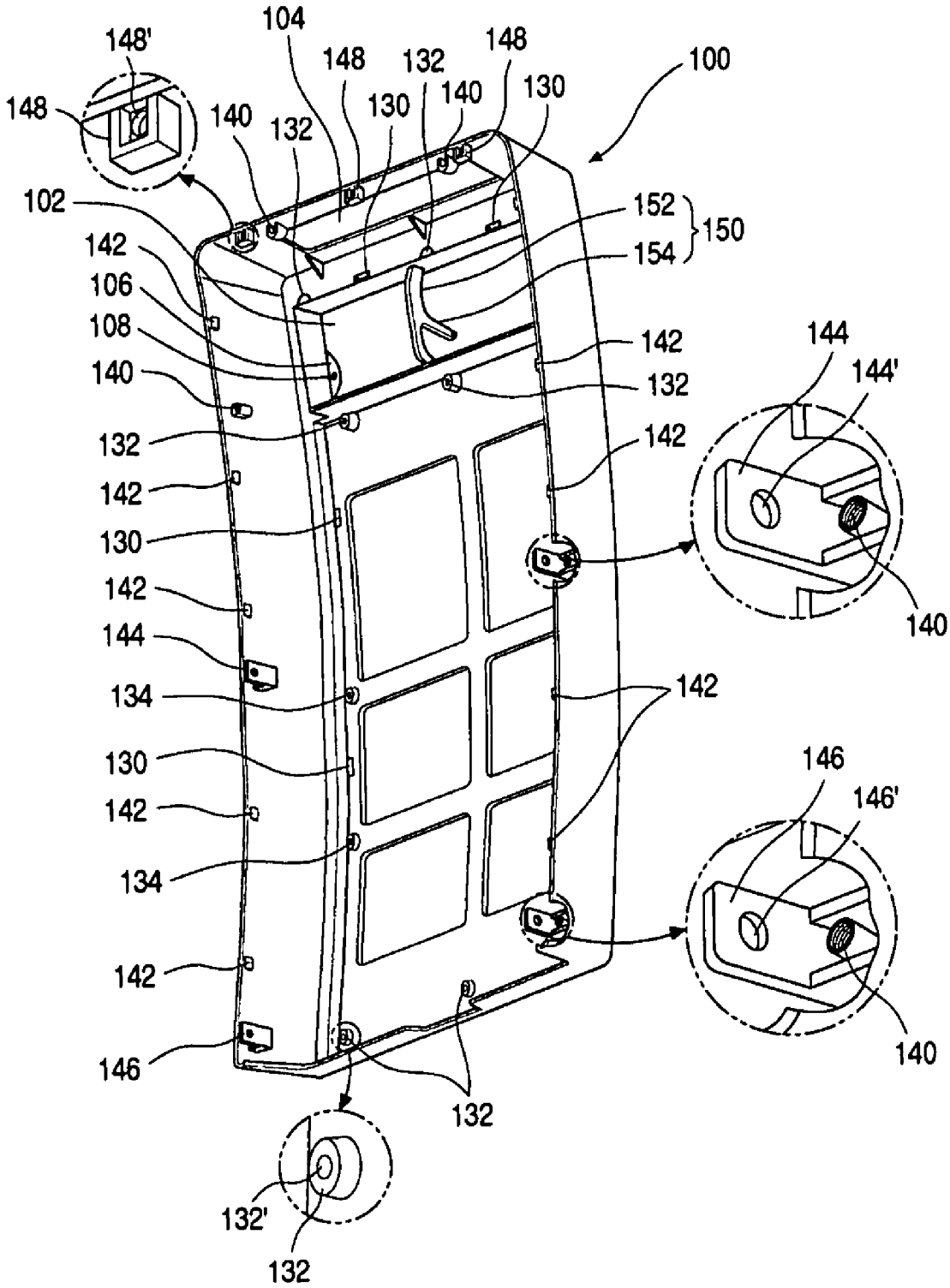

FIGS. 20 and 21 are front and rear perspective view of the front frame according to an embodiment of the present invention.

Referring to FIGS. 20 and 21, the front frame 100 is formed in a lattice shape having a plurality of rectangular openings. A reinforcing panel may be further installed on a rear surface of the front frame 100. The reinforcing panel functions as a sound-proof or sound-absorbing member or a moisture (condensed water) absorbing member.

In more detail, the front frame 100 is provided with a plurality of panel hook holes 130. Panel hooks (not shown) formed on a rear edge of the front panel 200 are inserted in the panel hook holes 130. The panel hook holes 130 are formed along the front edge of the front frame 100.

The front frame 100 is provided with a plurality of panel coupling parts 132. That is, three panel coupling parts 132 are formed on an upper end of the louver installing member 102 at predetermined intervals and three panel coupling parts 132 are formed on a lower end of the louver installing member 102 at predetermined intervals. Also, three panel coupling parts 132 are formed horizontally with a predetermined interval on a lower end of the front frame 100. The panel coupling parts 132 are parts through which coupling members (not shown) such as screws pass. Therefore, panel coupling holes 132' are formed in central parts of the panel coupling parts 132 to allow the coupling members to be inserted into and pass through the panel coupling holes 132'.

Also, additional coupling parts 134 are further formed on the front frame 100. The additional coupling parts 134 are formed in the same shapes as those of the panel coupling parts 132, but forming positions of the additional coupling parts 134 are different. That is, the additional coupling parts 134 are preferably formed at central parts of the front frame 100. In more detail, two additional coupling parts 134 are formed at left and right of a lower half of the front frame 100.

The additional coupling parts 134 serve as additional coupling means together with additional coupling projections 224 of the front panel 200. The additional coupling means is selectively used depending on a weight of the front panel 200. That is, the additional coupling means is used to allow the front panel 200 to be more solidly fixed on the front frame 100 in the case where a heavy part such as a glass is further installed on a front side of the front panel 200.

Therefore, a coupling member such as the panel coupling parts 132 passes through the additional coupling parts 134.

A plurality of frame coupling parts 140 are formed on lateral sides and an upper rear end of the front frame 100. The frame coupling parts 140 are parts to which coupling members (not shown) such as screws are coupled, and are formed at positions corresponding to the frame coupling projections 370 of the rear frame 300. Therefore, when the coupling members pass through the frame coupling projections 370 and couple to the frame coupling parts 140, the rear frame 300 and the front frame 100 are coupled to each other. Screw grooves to which coupling members such as screws are coupled are formed in central parts of the plurality of frame coupling parts 140.

A plurality of coupling guide ribs 142 protrude inward from a lateral rear end of the front frame 100. The coupling guide rib 142 is intended for guiding assembling of the front frame 100 and the rear frame 300, and is formed in a ' ⌐'or '⌐ 'shape (when seen from an upper side). Therefore, an edge of the rear frame 300 is inserted into a gap between the coupling guide rib 142 and the front frame 100.

A pair of drain coupling members 144 protrude inward from a lateral side of the front frame 100. The drain coupling members 144 protrude inward from both lateral sides of the front frame 100 to be symmetric with each other, and are formed in a ' ⌐'or '⌐ 'shape (when seen from an upper side).

The drain coupling members 144 allow the front frame 100 to be coupled to the main drain pan 700 using a coupling member. Therefore, a drain coupling hole 144' is formed in a rear end of the drain coupling member 144 to pass through the drain coupling member 144 so that a coupling member such as a screw passes through the drain coupling hole 144'.

Also, referring to FIG. 21, the frame coupling parts 140 are integrally formed with an inside of the drain coupling members 144.

A pair of base coupling members 146 protrude inward from a lateral lower end of the front frame 100. The base coupling members 146 protrude inward from both sides of the front frame 100 to be symmetric with respect to each other, and are formed in a ' ⌐'or '⌐ 'shape (when seen from an upper side) as in the drain coupling members 144.

The base coupling members 146 are intended for allowing the front frame 100 and the base pan 500 to be coupled to each other using a coupling member such as a screw. Therefore, a base coupling member 146' is formed in a rear end of the base coupling member 146 to pass through the base coupling member 146 so that a coupling member such as a screw passes through the base coupling member 146'.

Also, the frame coupling part 140 is integrally formed with an inside of the base coupling member 146 as in the inside of the drain coupling member 144.

A plurality of air guide coupling members 148 are formed at an upper rear end of the front frame 100. The air guide coupling members 148 are intended for the upper air guide 800 to be coupled to the front frame 100. Three air guide coupling members 148 are formed with a predetermined interval at a lower side of an upper rear end of the front frame 100. An air guide coupling hole 148' is formed in the air guide coupling members 148 to pass through the air guide coupling members 148 so that a coupling member such as a screw passes through the air guide coupling hole 148'.

Louver installation parts 106 are formed on both sides of the louver installation opening 102, respectively. The louver installation parts 106 are parts at which both ends of the discharge louver 110 is installed and supported, and are formed in a semicircle shape protruding to the front in a rounded shape.

Also, a louver installation groove 108 is recessed in a lateral direction from an inner lateral side of the louver installation part 106. A louver rotational shaft 111 of the discharge louver 110 is inserted into the louver installation groove 108. The louver installation groove 108 is formed in each of lateral sides of the pair of the louver installation parts 106. A front side of at least one of the two louver installation grooves 108 is preferably open to allow the louver rotational shaft 111 to be easily installed.

A louver motor (not shown) providing rotational power to the discharge louver 110 is installed inside at least one of the pair of the louver installation parts 106 formed at both ends of the louver installation opening 102.

A louver support 150 is integrally formed at a central part of the louver installation opening 102. The louver support 150 is vertically formed to support a central part of the discharge louver 110.

The louver support 150 includes a connection part 152 installed vertically across the louver installation opening 102, and a stopper 154 extending to the front from a central part of the connection part 152. Also, an upper end and a lower end of the stopper 154 contact a groove front side 114' and a groove lower side 114" of the discharge louver 110 to limit a rotation range of the discharge louver 110.

Figure 22:
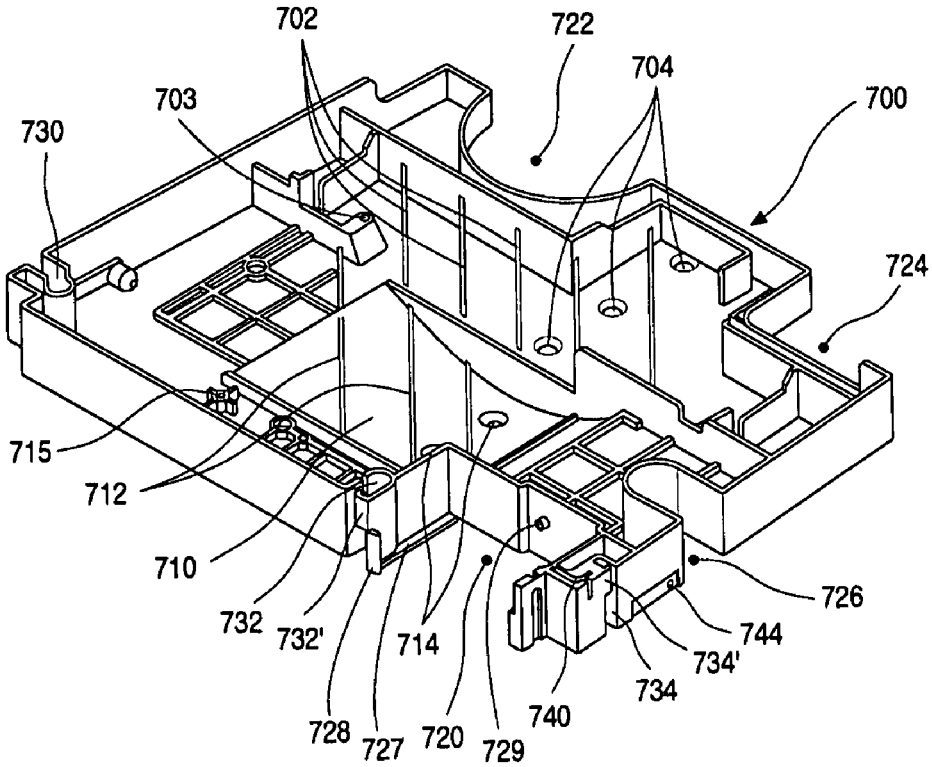
FIGS. 22 and 23 are respectively top and bottom perspective views of a main drain pan according to an embodiment of the present invention.
Figure 23:
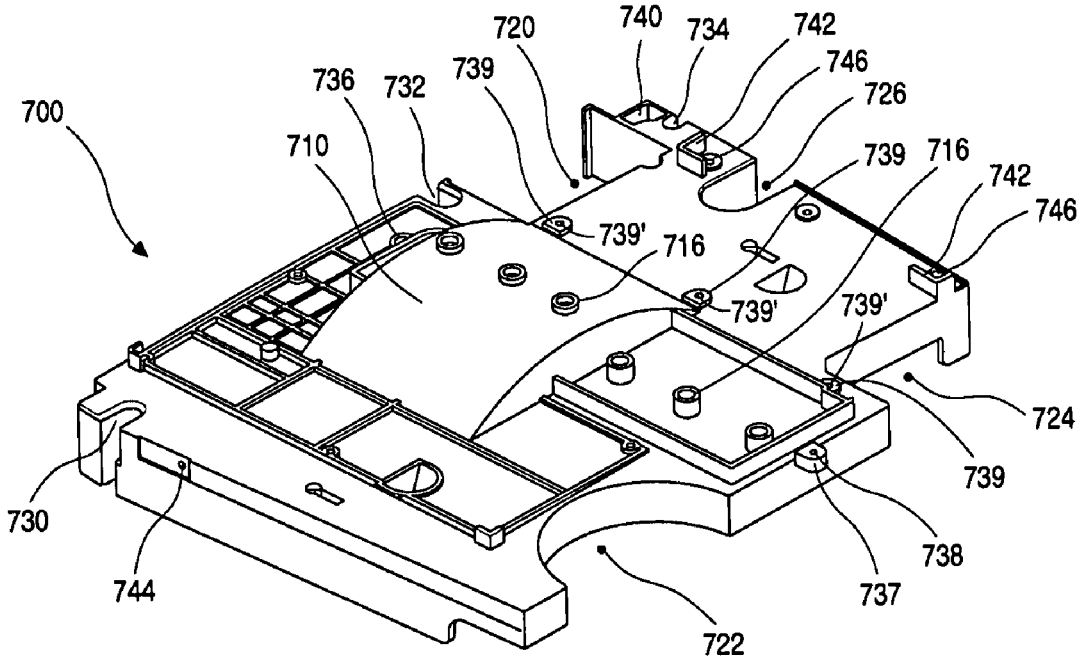

FIGS. 22 and 23 are respectively top and bottom perspective views of the main drain pan according to an embodiment of the present invention.

Referring to FIGS. 22 and 23, as described above, the main drain pan 700 has an about quadrangle-shaped appearance, and is installed on a central portion between the front frame 100 and the rear frame 300 to divide a space formed by the front and rear frames 100 and 300 into an upper portion and a lower portion.

A plurality of bottom partition ribs 702 are formed on an upper surface of the main drain pan 700 as illustrated. The bottom partition ribs 702 allow a plurality of chambers to be formed on the upper surface of the main drain pan 700 so that spaces through which condensed water can flow.

In more detail, the plurality of bottom partition ribs 702 are formed on the upper surface of the main drain pan 700 with an equal interval. These bottom partition ribs 702 are integrally formed with the main drain pan 700, and protrude upward from the upper surface of the main drain pan 700.

The plurality of bottom partition ribs 702 allow a plurality of parts such as the second heat exchanger 860 installed above the main drain pan 700 not to closely contact the upper surface of the main drain pan 700, so that a predetermined space is formed. Accordingly, condensed water that has been generated from the second heat exchanger 860 and fallen down can easily flow on the upper surface of the main drain pan 700.

Meanwhile, the bottom partition ribs 702 are inclined at predetermined angles with respect to a front side and a lateral side of the main drain pan 700. That is, the bottom partition ribs 702 have a shape inclined to the left to guide flowing of condensed water.

A plurality of bottom condensed water holes 704 are formed in the main drain pan 700 to vertically pass through the main drain pan 700. The bottom condensed water holes 704 allow condensed water that has been generated from the second heat exchanger 860 and fallen down to move below the main drain pan 700.

A housing seat groove 710 recessed downward is further formed on a front half of the main drain pan 700. The housing seat groove 710 is intended for preventing interference with an upper fan housing 810 formed on the upper air guide 800. Therefore, the housing seat groove 710 is formed in an arc shape corresponding to a shape of a lower end of the upper fan housing 810, so that the lower end of the upper fan housing 810 is received in an upper side of the housing seat groove 710.

A plurality of groove partition ribs 712 are integrally formed with an equal interval on the housing seat groove 710. The groove partition ribs 712 are formed in a shape corresponding to a shape of the bottom partition ribs 702. Therefore, the groove partition ribs 712 are formed to be inclined to the left at a predetermined angel, and protrude upward from an upper surface of the housing seat groove 710. Also, groove condense water holes 714 are formed in the housing seat groove 710 to vertically pass through the housing seat groove 710. The groove condensed water holes 714 have the same shape as that of the bottom condensed water hole 704, and perform the same function.

Also, the plurality of groove condensed water holes 714 are formed in a lowermost end of the housing seat groove 710. That is, the groove condensed water holes 714 are formed in a lowest portion of the housing seat groove 710 that is recessed and rounded downward and has a cross-section of an arc shape (when seen from a front side). This is for swiftly draining condensed water collected in the housing seat groove 710 to a lower side.

An upper air guide coupling part 715 is provide at a portion spaced apart from the housing seat groove 710. The air guide coupling part 715 is coupled to an air guide coupling block (818 of FIG. 25) to prevent the upper orifice 860 from being separated from the main drain pan 700.

Condensed water falling guides 716 are further formed on a lower surface of the main drain pan 700. The condensed water falling guides 716 allow condensed water moving a lower side of the main drain pan 700 via the condensed water holes 704 and 714 to swiftly and directly fall down. That is, the condensed water falling guides 716 allow the condensed water that has moved to the lower side of the main drain pan 700 to directly fall down without flowing to other portions.

Therefore, the condensed water falling guides 716 protrude downward from a lower side of the main drain pan 700, and have a cylindrical shape. In more detail, the condensed water falling guides 716 extend downward from the condensed water holes 704 and 714. That is, the condensed water falling guides 716 extend downward from the bottom condensed water hole 704 and the groove condensed water hole 714, and are formed in a cylindrical shape corresponding to shapes of the condensed water holes 704 and 714.

Meanwhile, a plurality of grooves for avoiding interference with neighboring parts are formed in the main drain pan 700.

In more detail, a control box installation opening 720 is formed to be open on a front right end of the main drain pan 700. The control box installation opening 720 is formed in a size and a shape corresponding to a cross-section of the control box 880. Therefore, the control box 880 is installed vertically across the control box installation opening 720.

To this end, a control box support unit for supporting the control box 800 is provided on the main drain pan 700 and the control box 880. The control box support unit includes a control box seating part 727 and a control box support part 886.

In more detail, the control box installation opening 720 is provided at left and right lower ends with the control box seating part 727. The control box seating part 727 protrudes inward of the control box installation opening 720. The control box support part (886 of FIG. 28) seats on the top surface of the control box seating part 727.

The control box installation opening 720 is provided at a front end with a pair of removal preventing parts 728 having a predetermined size in a vertical direction. The removal preventing parts 728 function to prevent the control box 880 inserted in the control box installation opening 720 from be removed frontward.

That is, the control box 880 that is suppressed in the falling down by the control box seat portion 727 may move frontward. However, the removal preventing parts 728 fix the front left and right ends of the control box 880 to suppress the frontward movement of the control box 880.

Therefore, the removal preventing part 728 has a larger width than the control box seating part 727. A distance between the removal preventing parts 728 opposing each other may be less than a front left-right length of the control box 880. A lower part fixing unit for fixing the lower end of the control box 880 is further provided on the main drain pan 700 and the control box 880. The lower part fixing unit includes a control box lower part fixing part 729 and a lower fixing part coupling hole 894. In more detail, the control box installation opening 720 is provided at a rear portion with the control box lower part fixing part 729 protruding frontward. The control box lower part fixing part 729 serves to more securely mount the control box 880 in the control box installation opening 720. The control box lower part fixing part 729 is coupled by the lower part coupling hole (894 of FIG. 28) and the coupling member.

Therefore, the control box 880 seats on the control box seating part 727 and is prevented from moving frontward by the removal preventing part 728 and more securely mounted in the control box installation opening 720 by the control box lower part fixing part 729.

Meanwhile, a duct avoiding groove 722 is formed to be open in a rear direction in a rear left portion of the main drain pan 700. The duct avoiding groove 722 is intended for avoiding interference with a lower end of the exhaust guide unit 400. Therefore, the duct avoiding groove 722 has a semicircle shape corresponding to a front end of the exhaust guide unit 400.

A working hole 724 is formed in a rear right portion of the main drain pan 700. The working hole 724 is a portion formed by cutting a rear right edge of the main drain pan 700 in a 'L'shape. The working hole 724 is intended for easy working (e.g., after service) of an operator.

For example, the compressor 520 is installed below a right end of the main drain pan 700. The compressor 520 is covered with a protection cap (not shown). The working hole 724 is formed to allow an operator to easily mount the protection cap from an upper direction. A pipe passing groove 726 through which a coolant pipe (not shown) passes is formed in a right end of the main drain pan 700. That is, coolant flowing between the first heat exchanger 510, the compressor 520, and the second heat exchanger 860 flows via the coolant pipe formed of a pipe. This coolant pipe is vertically installed in the pipe passing groove 726. The pipe passing groove 726 is formed in a '⊂' shape (when seen from an upper direction) as illustrated.

A cord passing groove 730 is formed in a left front end of the main drain pan 700. The cord passing groove 730 is a groove through which a power cord (not shown) through which external power is applied, and a power line supplies power to the upper motor 820 pass. The cord passing groove 730 has a '⊃' shape (when seen from an upper direction).

A power line passing groove 732 is formed in a front end of the main drain pan 700. That is, the power line passing groove 732 is formed in a left side of the control box installation opening 720. The power line passing groove 732 is a portion through which various power lines supplied to the compressor 520 and the condensed water pump 550 pass.

The power line passing groove 732 is formed in a '∩' shape (when seen from an upper direction) as illustrated. A detachment preventing rib 732' for preventing the power line (not shown) inserted into the power line passing groove 732 from being detached to the front side is further formed at a front end.

An auxiliary groove 734 is further formed in the neighborhood of a right front end of the main drain pan 700. Like the power line passing groove 732, the auxiliary groove 734 is also intended for guiding a plurality of power lines. The auxiliary groove 734 is formed in a smaller size than that of the power line passing groove 732 to pass a DC power line therethrough.

The auxiliary groove 734 is formed in a '⊂' shape (when seen from an upper direction) as illustrated, and a DC line detachment preventing rib 734' is formed at a right end to prevent the power line from being detached.

Drain coupling parts 736, 737, and 739 for coupling with the sub-drain pan 750 are formed on the main drain pan 700. The drain coupling parts 736, 737, and 739 consist of a front drain coupling part 736 formed at a front end of the main drain pan 700, a rear drain coupling part 737 formed at a rear end of the main drain pan 700, and a right drain coupling part 739.

The front drain coupling part 736 is formed at a central front end of the main drain pan 700, and the rear drain coupling part 737 protrudes in a rear direction from a central rear end of the main drain pan 700. A drain coupling hole 738 through which a coupling member such as a screw passes is formed in central portions of the front drain coupling part 736 and the rear drain coupling part 737 to pass through the front drain coupling part 736 and the rear drain coupling part 737.

Three right drain coupling parts 739 are formed at a right portion of the main drain pan 700. That is, the right drain coupling parts 739 are formed at a rear end of the main drain pan 700, a right front end and a right rear end of the housing seat hole 710. A right drain coupling hole 739' like the drain coupling hole 738 is formed also in the right drain coupling part 739 to pass through the right drain coupling part 739.

An angle hole 740 is formed in a front right edge of the main drain pan 700. The angle hole 740 is a portion where a support angle 580 passes and is installed. Therefore, the angle hole 740 is formed in a '⌟'shape (when seen from an upper direction) corresponding to a cross-section of the support angle 580. The support angle 580 is inserted from above the angle hole 740.

The angle coupling parts 745 are concaved at the front and right sides of the angle hole 740. The angle coupling holes 745' are formed through the lower portion of the angle coupling part 745. The angle coupling holes 745' are formed to correspond to the drain coupling portions so that the coupling members can be inserted therethrough.

The angle coupling portions 745 are designed such that portions (e.g., screw heads) of the coupling members coupled to the angle coupling holes 745' does not protrude from the right surface of the main drain fan 700. The depth of the angle coupling part 745 is greater than a thickness of the screw head.

Also, brace support parts 742 are formed at the neighborhood of a lower right end of the main drain pan 700. The brace support parts 742 are a portion to and on which an upper end of the brace 570 is coupled and supported, protrudes downward (upward in FIG. 15) from a lower surface of the main drain pan 700, and is formed in a pair. That is, the brace support parts 742 are installed with a predetermined interval between them, and have a 'L'shape and a '⌟'shape (when seen from an upper direction in FIG. 15) that are symmetrical with each other as illustrated. A distance between the brace support parts 742 corresponds to a front-rear length of the drain pan support 574 (see FIG. 3).

Therefore, when the top surface of the drain pan support part 574 is located in the brace support 742, the movement frontward, leftward, rightward is limited.

A plurality of brace coupling parts 746 are provided between the brace support parts 742. The brace coupling parts 746 are interlocked with the support coupling holes 574' formed on the drain pan support part 574 at predetermined intervals by coupling members.

To this end, the brace coupling parts 746 are forced to correspond to the support coupling holes 574'.

Meanwhile, frame coupling parts 744 are formed in the neighborhood of left and right front ends of the main drain pan 700. The frame coupling parts 744 are screw grooves to which the coupling members such as screws are coupled to fix the main drain pan 700 to the front frame 100.

The pan frame coupling parts 744 are formed on a position and in a shape corresponding to the drain coupling holes 144' of the drain coupling members 144. Therefore, when the screws are coupled to the frame coupling grooves 744 after penetrating the drain coupling holes 144', the front end of the main drain pan 700 is fixed on the front frame 100.

Figure 24:
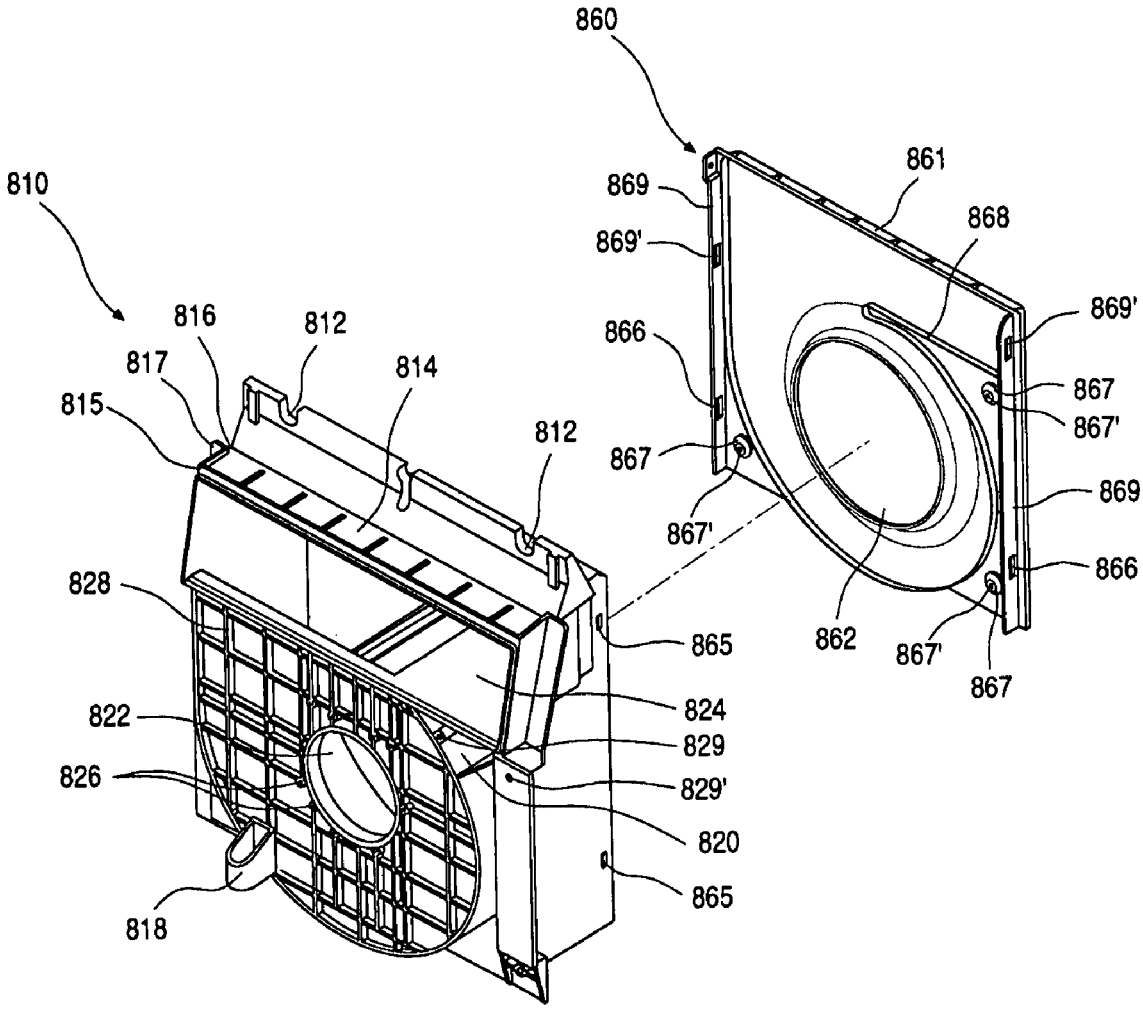
FIGS. 24 and 25 are front and rear perspective views illustrating a state where an upper air guide and an upper orifice are separated from each other according to an embodiment of the present invention.

The following will describe the upper air guide 810 and the upper orifice 960 that are major parts of the indoor blower unit 800 with reference to FIGS. 24 and 16*b*.

Referring to FIGS. 24 and 16*b*, three front coupling parts 811 are formed on an upper end of the upper air guide 810. The front coupling parts 811 are coupled to the air guide coupling holes 148 by coupling members to fix the upper air guide 810 to the front frame 100.

A pair of avoiding grooves 812 concaved downward are provided between the front coupling parts 811. The avoiding grooves 812 are formed to prevent the interference between the front and rear frames at their coupling ports.

That is, the front frame and the rear frame are assembled with each other by the coupling of the frame coupling parts 140 to the frame coupling projections 370. Therefore, if there is no avoiding grooves 812, the brake coupling projections 370 interfere with an upper portion of the upper air guide 810 and thus cannot be coupled to the frame coupling parts 811.

Therefore, the pair of avoiding grooves 812 are formed between the front coupling parts 811. At this point, the avoiding groove 812 has a width greater than an outer diameter of the frame coupling projection 370 so that it can be inserted in the frame coupling projection 370.

A dew guide part 814 is provided on a front half of the top surface of the upper air guide 810. The dew guide part 814 is formed in a rectangular shape to guide the condensed water formed on the top surface thereof rear-leftward.

That is, a discharge guide part 824 through which cool air is discharged to the room is formed under the dew guide part 814. When the cool air meets the warm air, dew is generated on the dew guide part 814.

Therefore, the dew guide part 814 guides the dew rear-leftward so as to disallow the dew drops frontward. The reason for guiding the dew rear-leftward is to prevent the dew is directed to the control box 880 provided at the right side of the upper air guide 810. That is, since many electronic components are installed in the control box 880, when the electronic components contact the water, there may be short-circuit. To this end, the rear end of the dew guide part 814 is lower than the front end. The left end of the dew guide part 814 is lower than the right end. Water falling preventing ribs 815 are provide on left/right ends and front end of the dew guide part 814. The water falling preventing ribs 815 function to prevent the dew falls frontward when a large amount of dew are abruptly generated on the dew guide part 814. A dew guide groove 816 is provided on a left-rear end of the water falling preventing ribs 815. The dew guide groove 816 guide the dew directed to the left rear portion of the dew guide part 814 to the left side of the upper air guide 810.

An upper motor hole 822 is formed on the front central portion of the upper air guide 810. Upper support coupling grooves 826 are formed around the upper motor hole 822. The upper support coupling grooves 826 are portions to which the coupling members penetrating the upper motor support 840 are coupled. The upper support coupling grooves 826 are formed along a concentric circle with the upper motor hole 822.

An air guide reinforcing rib 828 is provided on a front-lower portion of the upper air guide 810 to enhance the strength of the upper air guide 810. The air guide reinforcing rib 828 is formed on the front surface of the upper pan housing 820. In more detail, the air guide reinforcing rib 828 is formed in a mostly lattice shape. A control box upper part fixing part 829 is concaved on a front right central portion of the upper air guide 810. The control box upper fixing part 829 is coupled to the upper portion of the rear surface of the control box 880, being provided to fix the upper part of the control box 880 to the indoor blower unit 800.

Figure 28:
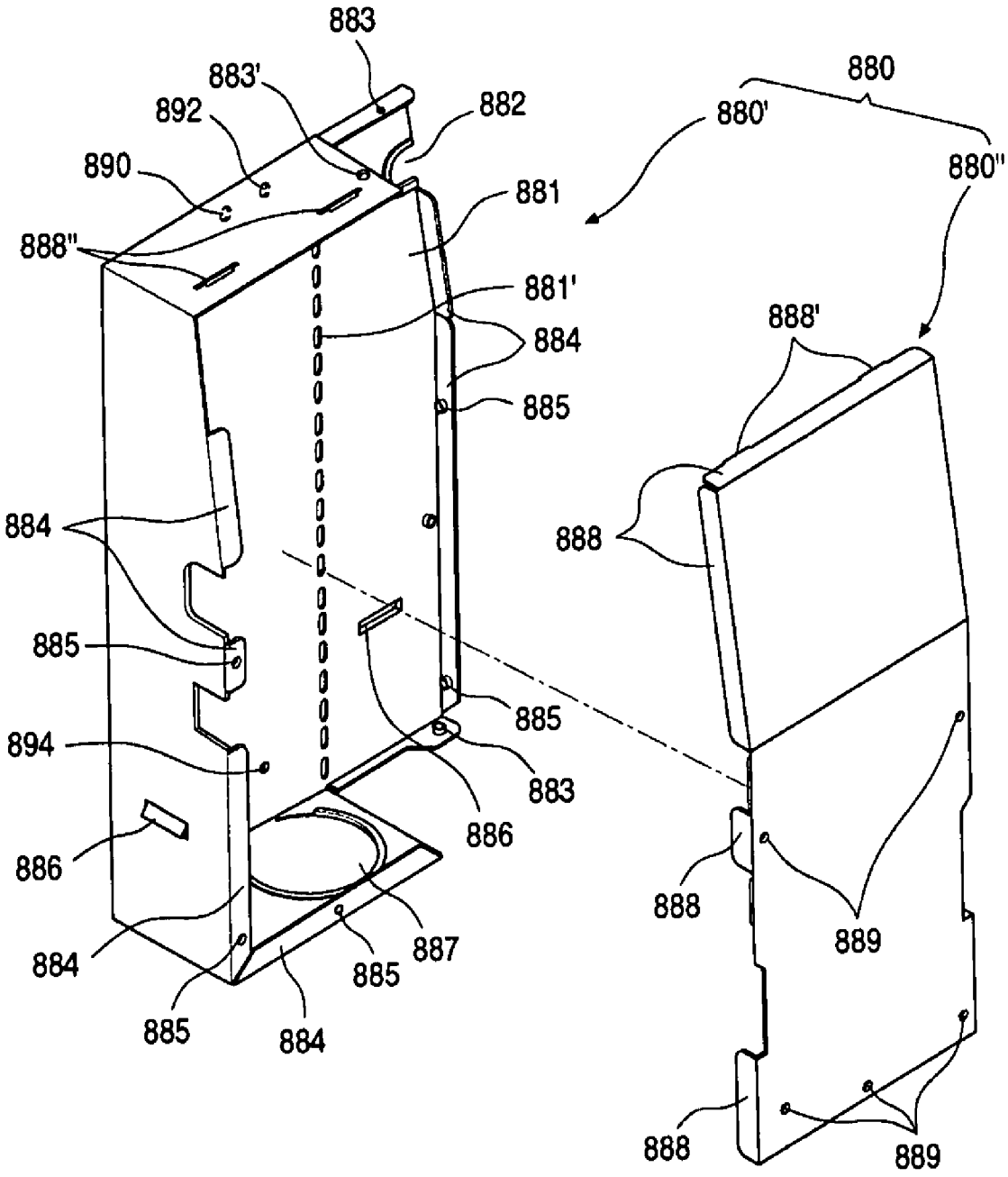
FIG. 28 is a front exploded perspective view of a control box according to an embodiment of the present invention.
Figure 29:
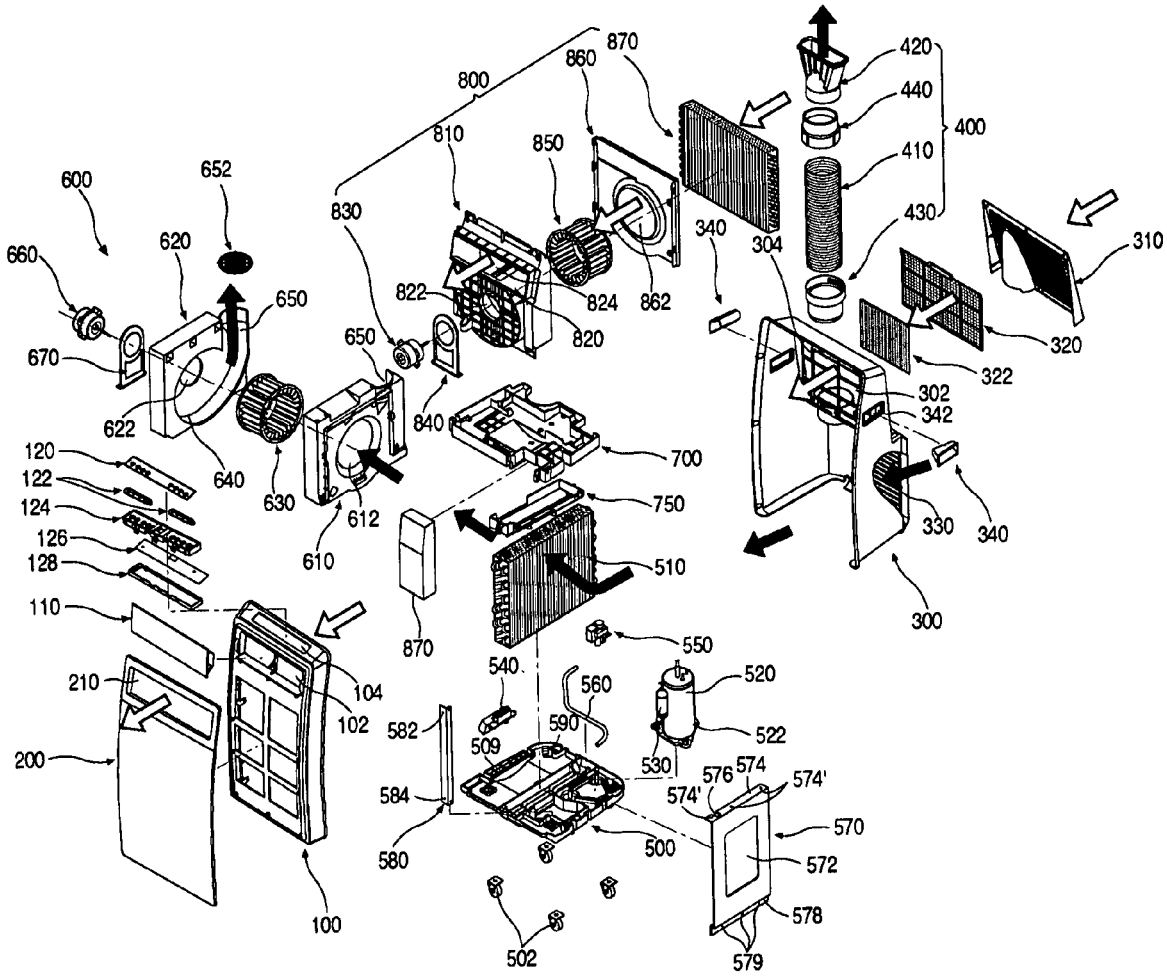
FIG. 29 is a view illustrating airflow of an air conditioner according to an embodiment of the present invention.

The control box upper fixing part 829 constitutes an upper fixing unit for fixing the upper part of the control box 880 to the front surface of the upper air guide 810 together with the upper fixing part coupling hole (890 of FIG. 28).

A control box sub-fixing part 829' is concaved at a portion spaced apart from the control box upper fixing part 829 rightward. Like the control box upper fixing part 829, the control box sub-fixing part 829' functions to fix the upper part of the control box 880 to the upper air guide 810.

That is, the control box upper fixing part 829 is structured to fix the upper-center of the control box 880 while the control box sub-fixing part 829' is structure to fix the upper-right side of the control box 880.

The control box sub-fixing part 829 together with an upper fixing sub-coupling hole (890 of FIG. 28) constitutes an upper sub-fixing unit for fixing the upper-right side of the control box 880 to the front right portion of the upper air guide 810. The upper sub-fixing unit is an additional structure that can be optionally formed.

The control box upper fixing part 829 is coupled to the upper fixing sub-coupling hole (890 of FIG. 28) and the control box sub-fixing part 829' is coupled to sub-fixing sub-coupling hole (892 of FIG. 28).

Therefore, when the control box upper fixing part 829 and the control box sub-fixing part 829' are respectively coupled to the upper fixing sub-coupling hole 890 and the sub-fixing sub-coupling hole 892, the upper part of the control box 880 is fixed on the indoor blower unit 800, i.e., on the front right side of the upper air guide 810.

If required, only one of the control box upper fixing part 829 and the control box sub-fixing part 829' may be selectively coupled.

An air guide coupling block 818 and an orifice coupling block 864 for fixing the front and rear halves of the indoor blower unit 800 to the top surface of the main drain pan 700 are formed on the lower parts of the front and rear surfaces of the upper air guide 810.

The air guide coupling block 818 protrudes frontward from the lower-left side of the upper air guide 810 and is coupled to the upper air guide coupling part 715 by a coupling member. The orifice block 864 protrudes from the lower left/right side of the front surface of the upper orifice 860 and is coupled to the upper orifice coupling unit 703.

Accordingly, the indoor blower unit 800 maintains its erection state without being separated from the top surface of the main drain pan 700.

Orifice coupling hooks 865 are provided on a rear half of the left and right sides of the upper air guide 810. The orifice coupling hooks 865 are inserted in hook insertion holes 869' so that the upper air guide 810 can be coupled to the upper orifice 860. The upper air guides 810 are formed on upper and lower parts of the left and right sides of the upper air guide 810.

A plurality of seat coupling grooves (866 of FIG. 25) are formed on a rear surface of the upper air guide 810. The seat coupling grooves 866 guides the coupling location of the upper orifice 860 and the upper air guide 810 and allows them to be coupled to each other. That is, the set coupling groove 866 is provided with insertion coupling projections (867 of FIG. 24) to guide the coupling location of the upper air guide 810 and the upper orifice 860. An air guide coupling groove 866' is provided on the center of the seat coupling groove 866.

Therefore, when the air guide coupling groove 866' is coupled to the insertion projection hole 867' by a coupling member such as a screw, the upper air guide 810 is completely coupled to the upper orifice 860.

Meanwhile, the upper orifice 860 is provided at a center with an upper orifice hole 862 and formed in a rectangular shape. The upper orifice 860 is provided at a front surface with a contact rib 868 corresponding to a rear end of the upper fan housing 820. The contact rib 868 contacts the upper fan housing 820 to prevent the air leakage. The contact rib 868 is slightly larger or smaller than the rear end of the upper fan housing 820. Therefore, when the upper orifice 860 is coupled to the upper air guide 810, the contact rib 868 closes the opening of the upper fan housing 820. The contact rib 868 is provided at an outer portion with an insertion coupling projection 867. The insertion coupling projection 867 is formed to correspond to the seat coupling groove 866 to be engaged with the seat coupling groove 866.

The insertion coupling projection 867 is provided at a center with an insertion projection hole 867'. The insertion projection hole 867' is coupled to the air guide coupling groove 866' by a coupling member. That is, as shown in FIG. 24, by inserting the coupling member into the insertion projection hole 867' from the rear side of the upper orifice 860, the insertion projection hole 867' is coupled to the air guide coupling groove 866'.

The upper orifice 869 is provided at left and right ends of the front surface with coupling ribs 869 protruding frontward with a predetermined width. The coupling rib 869 is provided at upper and lower portions with hook insertion holes 869'.

Therefore, when the orifice coupling hook 865 is inserted into the hook insertion holes 869', the outer surface of the coupling rib 869 contacts the inner left/right surfaces of the upper air guide '810 to prevent the air leakage.

Figure 25:
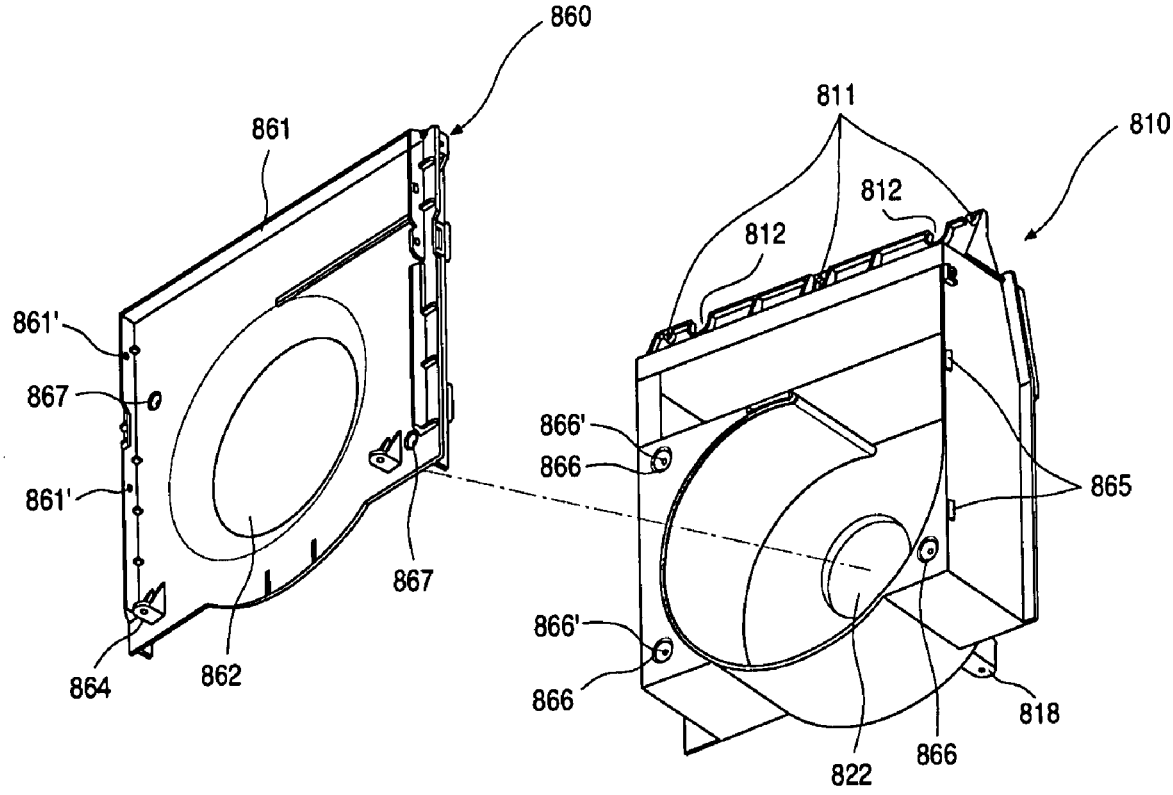

A seat flange 861 is provided on a rear edge of the upper orifice 860. The second heat exchanger 870 seats inside the seat flange 861 and is coupled thereto. That is, the seat flange 861, as shown in FIG. 25, has a "⊓"-shape and protrudes front ward. The seat flange 861 is slightly larger than the cross section of the second heat exchanger 870. A plurality of fixing holes 861' are formed on left and right sides of the seat flange 861. Therefore, after the second heat exchanger 870 seats in the seat flange 861, the coupling member inserted in the fixing hole 861' is coupled to a side of the second heat exchanger 870 and then the second heat exchanger 870 is securely fixed on the upper orifice 860.

Figure 27:
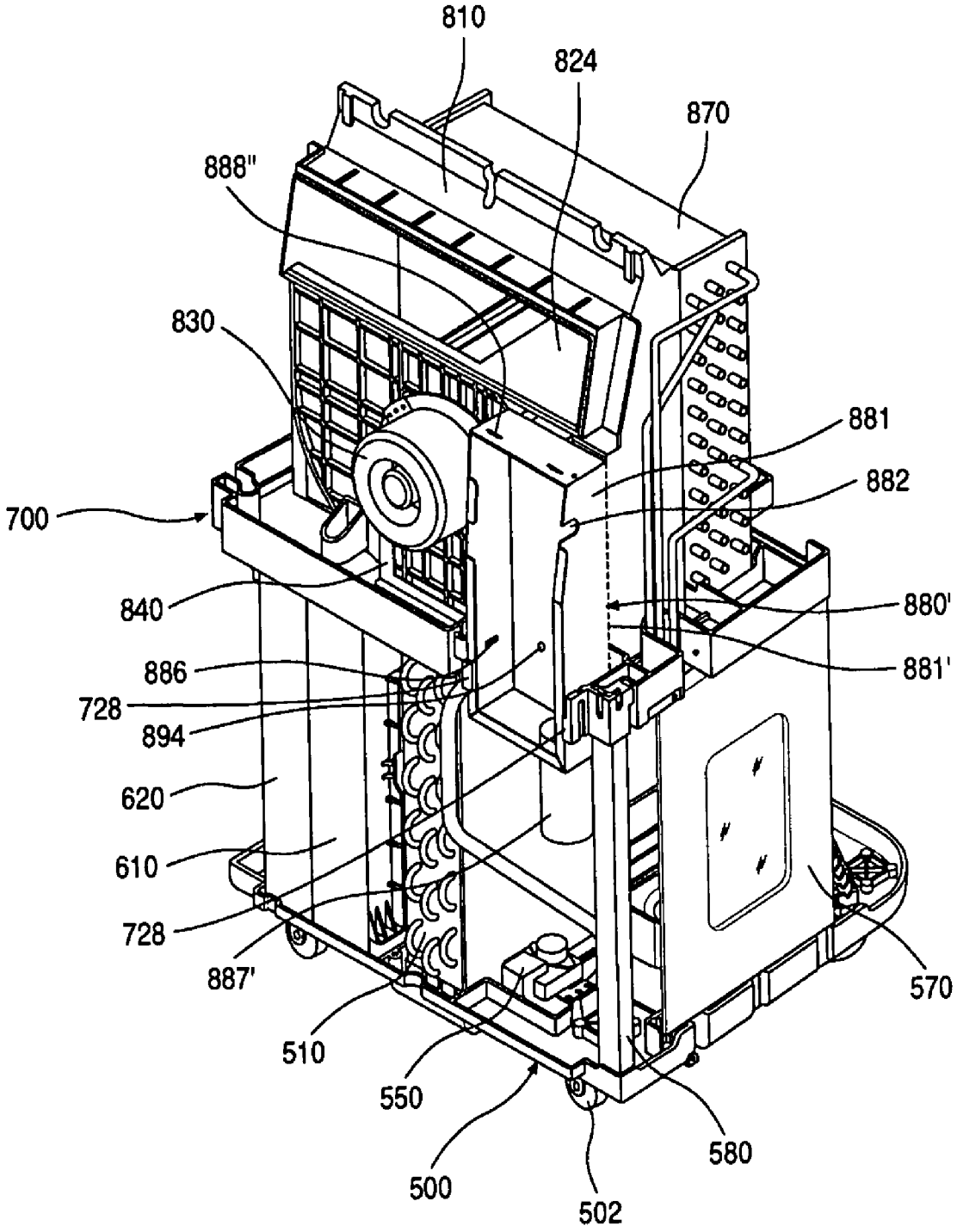
FIG. 27 is a perspective view of illustrating a mounting of a brace and a support angle according to an embodiment of the present invention.

The following will describe the control box in more detail with reference to FIGS. 27 and 28.

FIG. 28 is a front exploded perspective view of the control box according to an embodiment of the present invention.

Referring to FIGS. 7 and 8, the control box 880 includes a box body 880' formed in a rectangular parallelepiped shape has opening front and right sides and a box cover 880" closing the opened front side of the box body 880'.

A rear surface of the box body 880' extends rightward to form the side shielding part 881. A bending guide part 881' is formed through a left end of the side shielding part 881. The bending guide part 881' has a plurality of slots spaced apart from each other in a vertical direction by predetermined intervals. When the side shielding part 881 is bent clockwise with reference to the bending guide part 881'. The bending position is guide by the bending guide part 881'.

The side shielding part 881 is sized corresponding to the left side surface of the box body 880'. Therefore, when the side shield part 881 is bent clockwise with reference to the bending guide part 881', the side shielding part 881 defines the right surface of the box body 880'.

Therefore, when the side shielding part 881 is in a state illustrated in FIG. 28, the plurality of electronic components can be effectively installed.

The side shielding part 881 is provided at an upper-right end with a wide drawing part 882 concaved to be rounded leftward. The wire drawing part 882 is located on the front end when the side shielding part 881 rotates clockwise to define the right side surface of the box body 880'.

Therefore, after the electronic components are installed in the box body 880', when the wires connected to the electronic components are drawn out through the right side of the box body 880' and the side shielding part 881 pivots, the wires can be inserted inside of the wire drawing part 882.

The side shielding part 881 is provided at upper and lower ends with shielding part coupling holes 883. The shielding part coupling holes 883 are formed to maintain a bending state when the side shielding part 881 is bent to close the right side of the box body 880'. The shielding part coupling holes 883 are coupled to the shielding part suppressing holes 883' formed on right sides of the upper and lower surface of the box body 880'.

A plurality of body flanges 884 are provided on a left side front end of the box body 880' and a right side end of the side shielding part 881. The body flanges 884 are provided to allow the box body 880' to be coupled to the box cover 880" by coupling members such as screws. Some of the body flanges 884 are provided with a cover arresting hole 885.

The cover The cover arresting hole 885 is coupled to the body coupling hole 889 to arrest the box cover 880" so that the box cover 880" cannot be separated from the box body 880'.

The box body 880' is provided at a lower portion of the left side surface with a rectangular-shaped control box support part 886 and the side shielding part 881 is provided at a front-lower portion of the side shielding part 881 with a rectangular-shaped control part 886. The control box support part 886 interferes with a top surface of the control box seating part 727 so that the control box 880 maintains a fixed position inside of the control box installation opening 720.

That is, The control box support part 886 provided at a lower portion of the left side surface of the box body 880' are formed to have a lower end protruding outward and the control box support part 886 provided on a front-lower portion of the side shielding part 881 is formed to have a lower end protruding rearward.

Therefore, since the control box support parts 886 are located at left and right ends of the box body 880', the control box seating part 727 interferes with the control box support part 886 when the control box 880 is inserted downward from the removal preventing part 728.

The box body 880' is provided at a bottom with the capacitor exposing hole 887. The capacity exposing hole 887 is a portion in which a capacitor (887' of FIG. 27) functioning as a low capacity battery by accumulating electric charges is inserted. The capacity exposing hole 887 has an inner diameter corresponding to an outer diameter of the capacitor 887'.

Therefore, when the upper portion of the capacitor 887' is inserted downward into the capacitor exposing hole 887 after the lower portion of the capacitor 887' is inserted into the capacitor exposing hole 887, the capacitor 887' is exposed out of the control box 880.

This is for cooling the capacitor 887' using the airflow generated under the main drain pan 700.

Meanwhile, a plurality of cover flanges 888 are provided on an outer end of the box cover 880". The cover flanges 888 is provided to enclose a front half of the left/right side surfaces and upper/lower surfaces of the box body 880' when the box body 880' is coupled to the box cover 880". The cover flange 888 formed on an upper end of the box cover 880' is provided at a rear end center with a cover insertion projection 888'.

The cover insertion projection 888' is fitted in an insertion projection receiving part 888" formed on a top surface of the box body 880', functioning to arrest the upper end of the box cover 880' to prevent the box cover 880" from falling down.

The box cover 880" is provided at a front lower part with five body coupling holes 889. The body coupling holes 889 are coupled to and formed at locations corresponding to the cover arresting holes 885, allowing the box cover 880" to be coupled to the box body 880'.

Meanwhile, the box body 880' is provided at an inner wall center portion with an upper fixing part coupling hole 890. The upper fixing part coupling hole 890 is coupled to the control box upper fixing part 829 by a coupling member, allowing the control box 880 to be fixed to the upper air guide 810.

A sub-fixing part coupling hole 892 is formed on a right side of the upper fixing part coupling hole 890.

The sub-fixing part coupling hole 892 is formed to correspond to the control box sub-fixing part 829' and is a portion to which a coupling member is coupled. The upper right side of the control box 880 is fixed on a front surface of the upper air guide 810.

The cover body is provided at an inner lower portion with a lower fixing part coupling hole 894. The lower fixing part coupling hole 894 is provided to allow the lower portion of the control box 880 to be fixed to the main drain pan 700, being coupled to the control box lower fixing part 729 by a coupling member.

The following will describe the operation of the air conditioner according to the present invention with reference to FIG. 28.

First, flowing of coolant and air in the air conditioner according to the present invention will be described.

Though the air conditioner can be used for cooling and heating, description will be made for the case where the air conditioner is used for cooling.

The first heat exchanger 510 serves as a condenser, and the second heat exchanger 870 serves as an evaporator. Also, coolant pipes (not shown) are connected between the compressor 520, the first heat exchanger 510, and the second heat exchanger 870 to guide flowing of coolant.

Therefore, when gas coolant from the compressor 520 is compressed to become coolant of high temperature and high pressure, and flows into the first heat exchanger 510, the first heat exchanger 510 exchanges heat with outside air to condense coolant.

After that, condensed coolant expands while it passes through an expansion valve (not shown), and flows into the second heat exchanger 870. The coolant that has flowed to the second heat exchanger 870 exchanges heat with outside air to evaporate. Therefore, the coolant becomes a gas state. At this point, liquid state coolant also remains, so that coolant in two phases is mixed and present actually.

The coolant passes through the accumulator 530 and is sent back to the compressor 520 to complete a circulation cycle of the coolant.

Meanwhile, air exchanges heat while it passes through the first and second heat exchangers 510 and 870. This process is described with reference to FIGS. 1, 2, and 28.

First, air flow (denoted by '⇦' in FIG. 28) at a heat sinking side (a lower side of the main drain pan) is described. The air flow at this point is basically generated by the lower fan 630. That is, when the lower motor 660 is driven by power applied from the outside, the lower fan 630 connected to a shaft of the lower motor 660 rotates to generate air flow.

Therefore, air from a rear side flows in via the lower grill 330 formed in a lower half of the rear frame 300. The air flowing to the front via the lower grill 330 changes its direction to flow to the left side and pass through the first heat exchanger 510.

Temperature of air that passes through the second heat exchanger 870 is raised. That is, since the second heat exchanger 870 serves as a condenser, air receives heat from coolant flowing through the second heat exchanger 870 to become high temperature air The high temperature air that has passed through the second heat exchanger 860 passes through the lower orifice hole 602 to flow into a central portion of the lower fan 630. The air that has flowed into the central portion of the lower fan 630 flows radially as the fan 630 rotates, and is guided by the exhaust guides 650 and discharged upward.

High temperature air guided upward by the exhaust guides 650 is completely exhausted to an outside of a building via the exhaust guide element 400.

Next, air flow (denoted by '⬅' in FIG. 28) generated at a heat absorption side (an upper side of the main drain pan) is described. Air flow at this point is basically generated by the upper fan 850. That is, when the upper motor 830 is driven by power applied from the outside, the upper fan 850 connected to a shaft of the upper motor 830 rotates to generate air flow.

Therefore, air of an indoor space flows into the inside (the front side) via the intake grille 310 formed in an upper half of the rear frame 300. The air that flows in via the intake grille 310 sequentially passes through the pre-filter 320 and the deodorization filter 322, so that foreign substances or bad smell contained in the air is removed.

The air that has passed through the pre-filter 320 and the deodorization filter 322 exchanges heat with the second heat exchanger 870 while it passes through the second heat exchanger 870. That is, since the second heat exchanger 860 serves as an evaporator, air that passes through the second heat exchanger 870 is cooled down by exchanging heat with coolant flowing through the second heat exchanger 870.

Low temperature air that has passed through the second heat exchanger 870 flows to the front via the upper orifice hole 852 and flows into a central portion of the upper fan 850. The air that has flowed into the central portion of the upper fan 850 is discharged radially as the upper fan 850 rotates. The air is guided by the upper fan housing 820 to flow upward.

The air that flows upward by the upper fan housing 820 moves to the front via the discharge guide opening 824 of the upper air guide 810 to pass through the discharge louver 110. Low temperature air that passes through the discharge louver 110 is discharged to the front of the discharge hole 210 to cool down an indoor space. Meanwhile, a direction of the air that passes through the discharge louver 110 can be changed by a plurality of ribs formed on the discharge louver 110.

At this point, the cool air discharged through the discharge hole 210 meets the warm air above the dew guide part 814 to generate the dew. The dew flows left-rearward of the dew guide part 814 (see FIG. 24).

Then, the dew falls down to the left side of the indoor blower unit 800. Even when an amount of dew is steeply in creased, the dew cannot fall down frontward by the water falling preventing ribs 815 formed on the front end and left and right ends of the dew guide part 814.

The following will describe the power cord C on the top surface of the base pan 500 using the cord fixing member 590 with reference to FIGS. 8 through 13.

First, one of the plurality of receiving spaces 596 is selected depending on a thickness of the power cord C and the power cord C is inserted, when it is relatively thick, into the second receiving space 596", and when it is relatively thin, into the first receiving space 596'.

After the above, as shown in FIG. 12, the cord fixing member 590 is inclined rightward and in this state the fixing member hook projection 599 is inserted in the fixing member hook hole 506, after which the fixing member hook projection 599 is rotated counterclockwise.

At this point, the top surface of the fixing member hook projection 599 contacts the bottom surface of the cord seating part 504 to be arrested. The cord seating part 504 is reinforced and supported by the seating part reinforcing rib 504'.

The lower end of the pressing projection 597 presses the upper portion of the outer circumference of the power cord C downward.

Next, the coupling member S is inserted into the coupling hole 593 and the lower end of the coupling member S is coupled to the fixing member coupling hole 505.

By the above-described process, the fixing of the power cord C using the cord fixing member 590 is completed. After this, the power cord C drawn out rearward of the cord fixing member 590 is guided to the cord guide unit 508 and exposed out of the air conditioner through the cord exposing groove 508'.

The power cord C fixed by the above-described process is unrested when the cord fixing member 590 is in a separable state from the cord seating part 504 by releasing the coupling member S.

The following will describe a process for fixing the outdoor blower unit 600 to the base pan 500 with reference to FIGS. 14 through 19.

Figure 16:
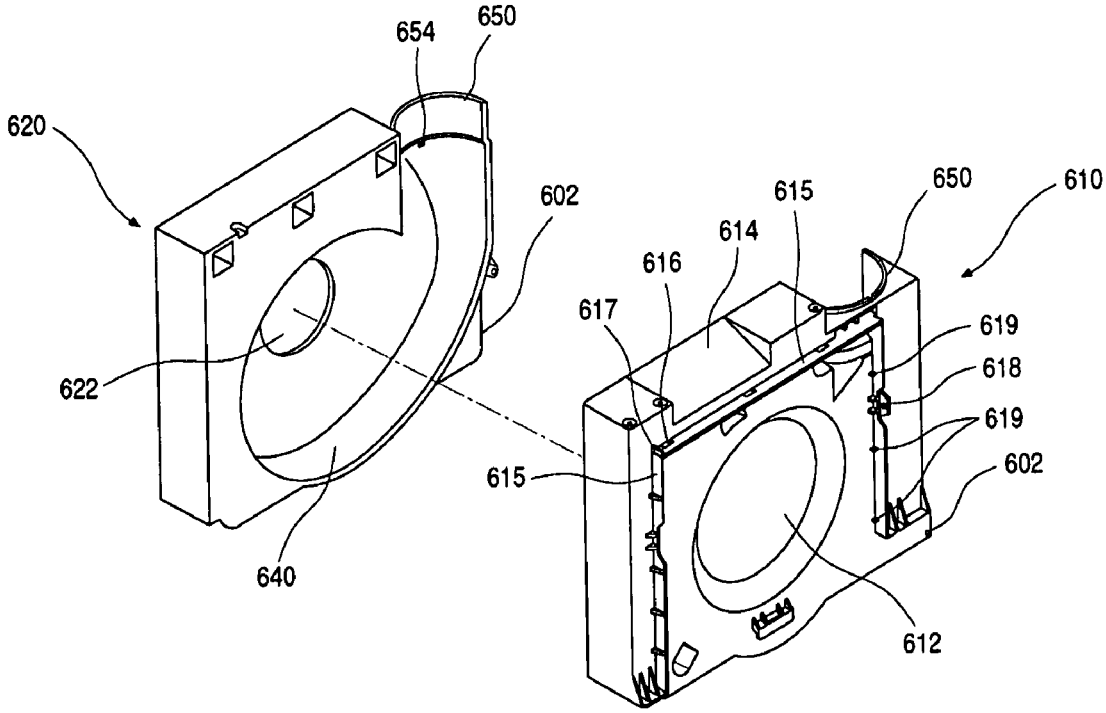
FIGS. 16 and 17 are respective front and rear perspective view illustrating a state where a lower air guide and a lower orifice are separated from each other according to an embodiment of the present invention.
Figure 17:
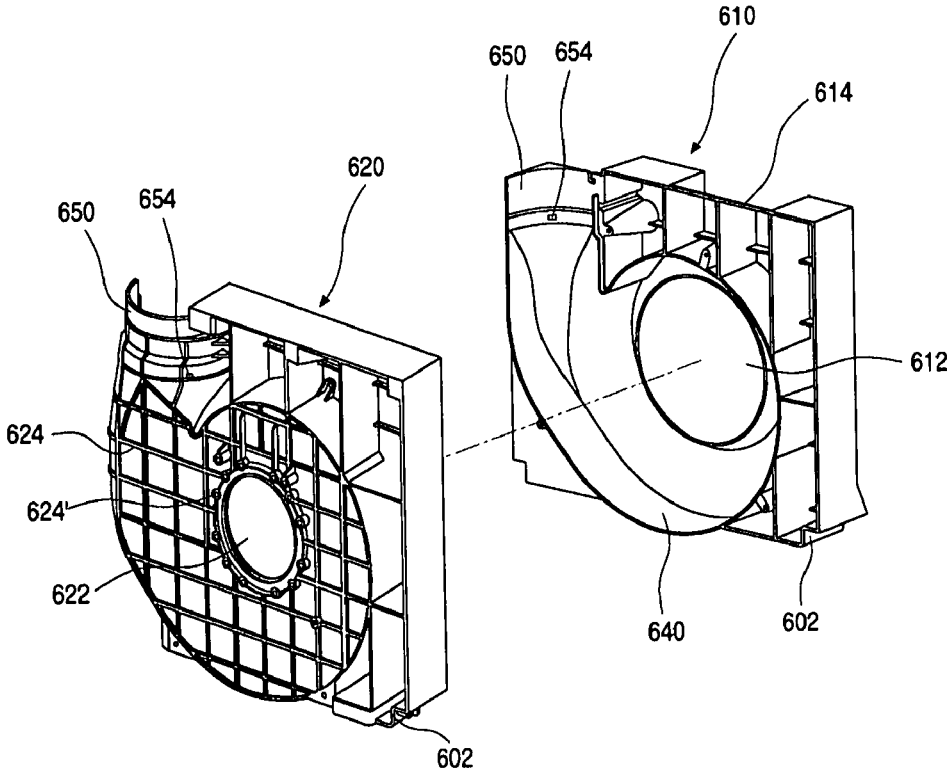
Figure 18:
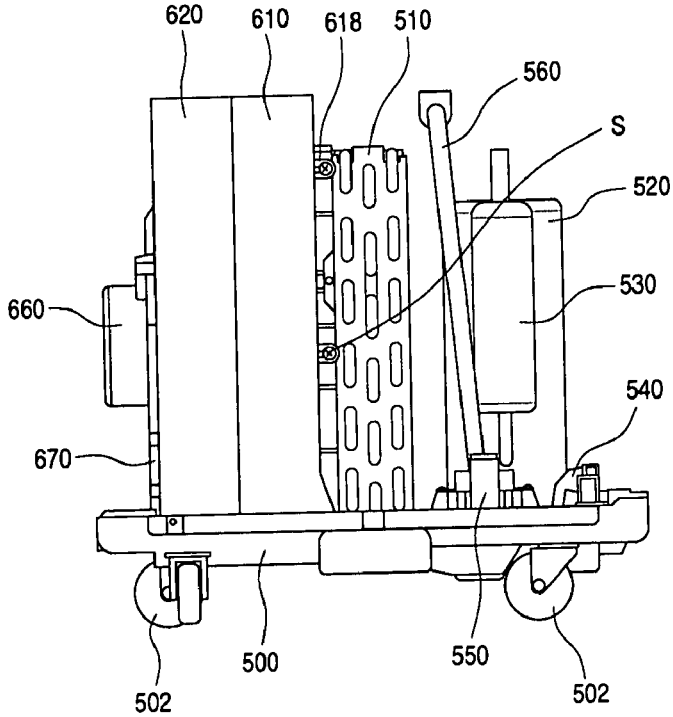
FIGS. 18 and 19 are respectively left and right side views illustrating a first heat exchanger coupled to an outdoor blower unit according to an embodiment of the present invention.

From a state illustrated in FIG. 16, after the lower fan 630 is located in front of the lower air guide 620, the lower motor 660 is moved frontward from the lower air guide 620 and inserted in the lower motor hole 622.

After the above, the lower motor 660 is axially coupled to the lower fan 630 and the exhaust grille 652 is located inside the exhaust guide. At this point, the grille projection 653 formed on the outer circumference of the exhaust grille 652 is inserted into the grill fixing groove 654.

When the lower fan 630, the lower motor 660, the exhaust grille 652 are preliminarily fixed to the lower air guide 620, the lower orifice 610 is coupled to the front portion of the lower air guide 620 using the coupling member.

After the outdoor blower unit 600 is erected as illustrated in FIG. 14, the insertion part 602 is inserted into the unit seating part 503. At this point, the unit seating part 503 receives the insertion part 602 and arrests the same and thus the outdoor blower unit 600 maintains it erection state on the top surface of the base pan 500.

Then, as shown in FIG. 15, the lower motor 660 is fitted on the upper portion of the lower motor support 670. At this point, the lower end of the lower motor support 670 contacts the top surface of the support seating part 509.

A plurality of coupling members are coupled to the support coupling grooves 624' and the support coupling grooves 509 after penetrating the upper and lower ends of the lower motor support 670.

By the above-described process, the outdoor blower unit 600 is supported on the base pan 500, and at the same time, the lower motor 660 is fixed by the lower motor support 670.

The following will describe the coupling process of the indoor blower unit 800, the front frame, and the rear frame with reference to FIGS. 18 through 26.

First, the completely disassembled indoor blower unit is assembled as shown in FIG. 24. That is, after the upper fan 850 is inserted into the upper fan housing 820, the upper motor 830 is inserted from the front side to the rear side for the axial coupling of the upper fan 850 to the upper motor 830.

After the above, the rear half of the upper motor 830 is inserted in the upper portion of the upper motor support 840 and the upper motor support 840 is coupled to the upper support coupling groove 826 using a coupling member such as a screw. At this point, the upper motor support 840 is coupled to the front surface of the upper air guide 810.

Next, the upper orifice 860 is coupled to the upper air guide 810. That is, the contact rib 968 is in contact with the rear end of the upper fan housing 820. Then, the orifice coupling hook 865 is inserted and fixed in the hook insertion hole 869'. At this point, the insertion coupling projection 867 is inserted into the seating coupling groove 866.

Next, a coupling bolt is inserted into the insertion projection hole 867' and the air guide coupling groove 866' to complete the coupling of the indoor blower unit 800.

The indoor blower unit 800 seats on the housing seating groove. At this point, the upper end of the indoor blower unit 800 is located between the air guide coupling opening and the frame coupling part 140.

After the above, the front coupling part 811 is coupled to the air guide coupling hole to fix the upper end of the indoor blower unit 800 to the front frame, and then the air guide coupling block 818, the air guide coupling part 715, and the orifice coupling block 864 and the upper orifice coupling part 703 are coupled to each other using coupling members such as screws, thereby fixing the lower portion of the indoor blower unit 800 to the top surface of the main drain fan 700.

Figure 26:
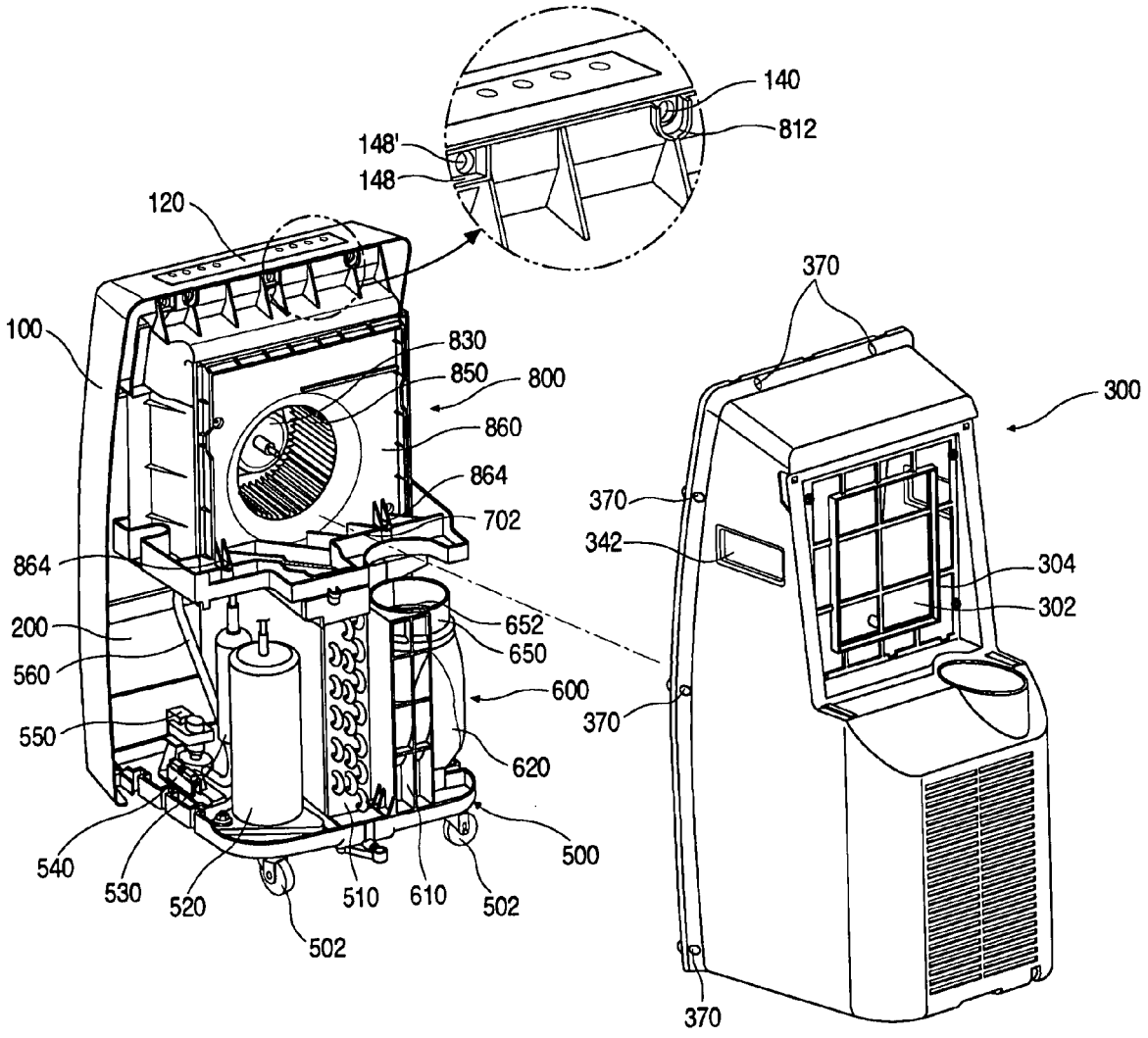
FIG. 26 is a rear perspective view of an indoor blower unit coupled to a front frame according to an embodiment of the present invention.

When the above-described assembling process is completed, the air conditioner is in a state illustrated in FIG. 26, after which the front end of the rear frame 300 contacts the rear end of the front frame 100. At this point, a coupling member is inserted in the frame coupling projection and coupled to the frame coupling part 140, thereby completing the assembling of the air conditioner is completed.

The following will describe a process for reinforcing the strength of the air conditioner using the support angle 580 and the brace 570 with reference to FIGS. 3, 14, 22, and 23.

First, as shown in FIG. 27, the outdoor blower unit 600 is installed on the left side of the top surface of the base pan 500 and the main drain pan 700 and the indoor blower unit 800 are installed on an upper portion of the outdoor blower unit 600. In this state, the brace 570 is erected at a right end between the base pan 500 and the main drain pan 700.

At this point, the brace 570 is disposed such that the upper end is more right side than the lower end, after which the brace coupling part 579 is inserted into the right side of the pair of the brace support parts 575.

At this point, since the lower end of the seating guide 577 is greater than the upper end, the insertion of the brace coupling part 579 is enabled. In addition, when the brace coupling part 579 is inserted, the guide 577 interferes with the lower end of the brace coupling part 579 in the right direction so that the right surface of the brace coupling part 579 contacts the left surface of the brace coupling part 577'.

When the brace coupling part 579 is completely inserted in the brace support part 575, the upper portion of the brace 570 is pushed leftward to rotate counterclockwise.

Then, the drain pan support part 574 interferes with the brace support part 742 and thus cannot rotate.

After the above, when the brace coupling part 746 is fixed to the support part coupling hole 574' using a coupling member such as a screw, the brace 570 supports the right end of the main drain pan 700.

Next, describing a process for supporting a right front end of the main drain pan 700 using the support angle 580, in a state where the support angle 580 is vertically erected, the lower end of the support angle 58 moves downward to be inserted into the angle hole 740. The lower end of the support angle 580 is inserted into the angle seating groove 586.

When the support angle seats on the angle seating groove 586, the lower end of the support angle 580 contacts the top surface of the base pan 500. At this point, the drain coupling part 582 and the angle coupling hole 745; and the base coupling part 584 and the angle fixing hole 588 are located to correspond to each other.

At this point, when coupled by the coupling member, the upper and lower parts of the support angle 580 are coupled to the main drain pan 700 and the base pan 500 to support the load of the right-front end of the main drain pan 700.

The following will describe a process for installing the control box 880 on the control box installation opening with reference to FIGS. 22, 24, 27, and 19.

In order to install the control box 880 on the control box installation opening 720, a plurality of electronic components including the capacitor 887' in the box body 880'. That is, the side shielding part 881 is coplanar with the rear surface of the control box 880 so that the electronic components can be installed in a state where the front and right sides of the box body 880' are opened.

Particularly, the capacitor 887' moves downward in the box body 880' to be inserted into the capacitor exposing hole 887 and then the capacitor 887' is fixed at its upper portion to the inner portion of the box body 880'.

Since the capacitor 880' generates a large amount of heat, the lower portion of the capacitor 887' is exposed through the lower side of the control box 880 so that the heat can be dissipated by the airflow generated from the outdoor blower unit 600.

When the installation of the electronic components in the box body 880', the plurality of wires are bundled and drawn out rightward, after which the side shielding part 881 are bent. That is, since the bending guide part 881' is provide on the left end of the side shielding part 881, the bending of the side shielding part 881 can be bent without applying strong force. The bent side shielding part 881 defines the right side surface of the box body 880'. At this same time, the wires are inserted in the wire drawing part 882 and the interference with the side shielding part 881 is released.

After the above, in order to prevent the side shielding part 881 is opened again counterclockwise with reference to the bending guide part 881', the shielding part coupling hole 883 and the shielding part arresting hole 883' are coupled by the screw.

When the above-described process, the box body 880' seats on the control box seating part 727. In more detail, after the box body 880' is located such that the opening front portion of the box body 880' is oriented toward the front portion 22 of the main drain pan 700, the box body 880' is inserted downward into the control box installation opening 720.

In the course of inserting the box body 880' into the control box installation opening 720, the control box support part 886 interferes with the control box seating part 727 and, by this interference, the box body 880' does not fall down and is inserted into the control box installation opening 720 to across vertically the front right side of the main drain pan 700 (see FIG. 27).

At this point, the removal preventing part 728 interferes with the left/right sides of the front end of the box body 880' to prevent the box body 880' from moving frontward.

After the above, the upper fixing part coupling hole 890 and the sub-fixing part coupling hole 892 are respectively coupled to the upper fixing sub-coupling hole 890 and the control box sub-fixing part 829' that are illustrated in FIG. 24, thereby fixing the upper portion of the box body 880' to the right side of the front surface of the upper air guide 810.

Next, the lower portion of the box body 880' is fixed to the front surface of the main drain pan 700. That is, by coupling a coupling member to the lower fixing part coupling hole 894 and the control box lower fixing part 729 illustrated in FIG. 22, the lower portion of the box body 880' is fixed to the main drain pan 700.

After the above-described process is completed, the mounting of the box body 880' in the control box installation opening 720 is completed. At this point, the front portion of the box body 880' is in an opened state. Therefore, the opened front portion of the box body 880' is closed by coupling the box cover 880".

That is, by inserting the cover insertion projection 888' into the insertion projection receiving part 888", the upper portion of the box cover 880" is hooked and fixed to the top surface of the box body 880', after which, by coupling a coupling member to the body coupling hole 889 and the cover arresting hole 885, the assembling and mounting of the control box 880 are completed.

Meanwhile, when there is a need for maintenance due to the damage of the electron components mounted in the control box 880, the box cover 880" is separated. To this end, when the coupling member is released from the body coupling hole 889, the box cover 880" can be separable from the box body 880'.

It will be apparent to those skilled in the art that various modifications and variations can be made in the present invention. Thus, it is intended that the present invention covers the modifications and variations of this invention provided they come within the scope of the appended claims and their equivalents.

For example, as far as the box body 880' may be selectively closed at its one side surface and the capacitor 887' is partly exposed to an external side of the box body 880', the side shielding part 881 and the capacitor exposing hole 887 can be formed on any portion of the box body 880'.

In the embodiment of the present invention, although the control box 880 is designed to across rightward when viewed from the front side of the main drain pan 700, the control box 880 may be designed to across in other direction depending on a flow direction of the air generated by the outdoor blower unit 600.

What is claimed is:

1. An air conditioner comprising:

a front frame, a rear frame and a base pan defining an outer appearance of the air conditioner;

a condenser that allows indoor air to be heat-exchanged with refrigerant;

an evaporator that allows outdoor air to be heat-exchanged with refrigerant;

an indoor blower unit that guides introduction and discharge of indoor air;

an outdoor blower unit that discharges the heat exchanged air with a refrigerant to an outdoor side;

a control box in which a plurality of electronic components controlling the operation of the air conditioner are installed; and a drain pan that divides an inner space between the front and rear frame into an upper half accommodating the condenser and a lower half accommodating the evaporator, the drain pan including a control box installation opening, wherein the control box is installed in the control box installation opening, one end of the control box being disposed above the drain pan and the other end of the control box being disposed below the drain pan, and wherein the indoor air passing the condenser flows to the indoor blower unit and the indoor air passing the indoor blower unit flows to the control box so that the control box is cooled by the indoor air.

2. The air conditioner according to claim 1, wherein the control box installation opening is formed at an end of the drain pan, and wherein the control box installation opening is indented inward from an outer surface of the drain pan.

3. The air conditioner according to claim 2, wherein the control box is fixed on the indoor blower unit and the drain pan.

4. The air conditioner according to claim 2, further comprising a control box support unit for supporting the control box on the drain pan, wherein the control box support unit includes a control box seating part and a control box support part that are respectively formed on the drain pan and the control box.

5. The air conditioner according to claim 4, wherein the control box seating part is formed on both side lower ends of the control box installation opening and protrudes inward of the control box installation opening.

6. The air conditioner according to claim 4, wherein the control box support part protrudes from a side surface of the control box to an outer side.

7. The air conditioner according to claim 2, wherein the control box installation opening is provided at a front end with a removal preventing part for preventing the control box inserted in the control box installation opening from being separated frontward.

8. The air conditioner according to claim 3, wherein the control box has a lower end fixed to the drain pan by a lower fixing unit and an upper end fixed to an upper air guide constituting the indoor blower unit by an upper fixing unit.

9. The air conditioner according to claim 8, wherein the lower fixing unit includes a control box lower fixing part protruding frontward from a rear end of the control box installation opening and a lower fixing part coupling hole formed in a lower half of the control box.

10. The air conditioner according to claim 8, wherein the upper fixing unit includes a control box upper fixing part formed on a front right side of the upper air guide and an upper fixing part coupling hole formed in a center of an upper half of the control box.

11. The air conditioner according to claim 10, wherein the upper fixing unit is provided at a side with an upper sub-fixing unit for selectively aiding the upper end of the control box to be securely fixed to the air guide.

12. The air conditioner according to claim 11, wherein the upper sub-fixing unit allows a right side of an upper end of the control box to be fixed to a front right side of the upper air guide and includes a control box sub-fixing part spaced apart rightward from the control box upper fixing part and a sub-fixing part coupling hole formed on a right side of the upper fixing part coupling hole.

13. The air conditioner according to claim 1, wherein the control box includes:

a box body, in order to accommodate the electronic components therein, comprising a rear surface, an upper surface formed at an upper end of the rear surface, a lower surface formed at a lower end of the rear surface, a first side surface formed at one side end of the rear surface, and a side shielding part which defines a second side surface of the box body by being bent at the other side end of the rear surface; and a box cover for closing an opening front portion of the box body, in such a manner that the rear surface of the box body faces the box cover after finishing installation of the electronic components.

14. The air conditioner according to claim 13, wherein the control box is provided at least one of the rear surface, the upper surface, the lower surface, the first side surface and the second side surface with a capacitor exposing hole in which a capacitor is installed crossing thereof.

15. The air conditioner according to claim 13, wherein the side shielding part is bent along a bending guide part, which has a plurality of slots spaced apart from each other in a vertical direction by predetermined intervals.

* * * * *